US009996017B2

(12) United States Patent
Shirai et al.

(10) Patent No.: US 9,996,017 B2
(45) Date of Patent: Jun. 12, 2018

(54) ELECTROSTATIC LATENT IMAGE DEVELOPING TONER

(71) Applicant: Konica Minolta, Inc., Tokyo (JP)

(72) Inventors: Aya Shirai, Hino (JP); Kouji Sugama, Musashino (JP); Shiro Hirano, Hachioji (JP); Noboru Ueda, Mitaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/623,600

(22) Filed: Jun. 15, 2017

(65) Prior Publication Data

US 2017/0371256 A1 Dec. 28, 2017

(30) Foreign Application Priority Data

Jun. 23, 2016 (JP) ..... 2016-124028

(51) Int. Cl.
*G03G 9/087* (2006.01)
*G03G 9/08* (2006.01)

(52) U.S. Cl.
CPC ..... *G03G 9/08782* (2013.01); *G03G 9/0821* (2013.01); *G03G 9/0827* (2013.01); *G03G 9/08711* (2013.01); *G03G 9/08755* (2013.01); *G03G 9/08784* (2013.01)

(58) Field of Classification Search
CPC ..... G03G 9/0821; G03G 9/08784; G03G 9/08786; G03G 9/08788; G03G 9/08755; G03G 9/08782
See application file for complete search history.

(56) References Cited

U.S. PATENT DOCUMENTS

2016/0202625 A1* 7/2016 Obara ..... G03G 9/0819 430/108.7

FOREIGN PATENT DOCUMENTS

JP 2012168505 A 9/2012
JP 2015045850 A 3/2015

* cited by examiner

*Primary Examiner* — Janis L Dote
(74) *Attorney, Agent, or Firm* — Lucas & Mercanti, LLP

(57) ABSTRACT

An object of the present invention is to provide an electrostatic latent image developing toner containing: a binder resin; and a releasing agent, wherein the binder resin contains a crystalline polyester resin; an endothermic peak top temperature of the electrostatic latent image developing toner is 70° C. or more measured with differential scanning calorimetry (DSC) in a heating-up period of the toner; and a heat value $\Delta H_c(L)$ is 15% or less with respect to a heat value $\Delta H_c$, wherein the heat value $\Delta H_c(L)$ is a heat value in the range of (an exothermic peak top temperature $r_c$−7° C.) or less; and the heat value $\Delta H_c$ is a heat value of the total exothermic peak measured with DSC in a heating-down period of the toner.

8 Claims, 3 Drawing Sheets

ELECTROSTATIC LATENT IMAGE DEVELOPING TONER

Japanese Patent Application No. 2016-124028 filed on Jun. 23, 2016 with Japan Patent Office, including description, claims, drawings, and abstract, the entire disclosure is incorporated herein by reference in its entirety.

TECHNOLOGICAL FIELD

The present invention relates to an electrostatic latent image developing toner. More specifically, the present invention relates to an electrostatic latent image developing toner which is excellent in low-temperature fixing property (fixability) and does not produce image noise after keeping it fora long period of time under the condition of high temperature and high humidity.

BACKGROUND

In recent years, in an image forming apparatus using an electrophotography, it has been required an electrostatic latent image developing toner (hereafter, it is also simply called as "a toner") which is thermally fixed at a low temperature. As a toner provided with this property, it is necessary to decrease a melting temperature and a melting viscosity of a binder resin.

For this, it was proposed a toner achieving a low temperature fixability by adding a crystalline resin such as a crystalline polyester resin as a plasticizer (a fixing auxiliary agent) (refer to Patent document 1: JP-A 2015-45850 and Patent document 2: JP-A 2012-168505, for example).

However, when a toner contains a crystalline resin as described, the toner has a problem of having a low thermal stability. In particular, when the toner is kept at high-temperature and high-humidity conditions for a long period of time, bleed out of the releasing agent may occur. This may produce a problem of contaminating the development sleeve or the photoreceptor producing to produce an image noise.

SUMMARY

The present invention was done based on the above-described situation. An object of the present invention is to provide an electrostatic latent image developing toner excellent in low-temperature fixability without producing an image noise even after keeping it fora long period of time under the conditions of high temperature and high humidity.

The present inventors have investigated the reasons of the above-described situation to solve the above-described object of the present invention. It was fond to provide an electrostatic latent image developing toner excellent in low-temperature fixability without producing an image noise even after keeping it for a long period of time under the conditions of high temperature and high humidity.

The inventive toner has the following embodiment. The toner has: an endothermic peak top temperature of 70° C. or more measured with differential scanning calorimetry (DSC) in a heating-up period of the toner; and a heat value $\Delta H_c(L)$, which is a heat value in the range of (an exothermic peak top temperature $r_c$−7° C.) or less, is made to be 15% or less with respect to a heat value $\Delta H_c$, which is a heat value of the total exothermic peak measured with DSC in a heating-down period of the toner.

The above-described object of the present invention can be solved by the following embodiments.

1. An electrostatic latent image developing toner comprising: a binder resin; and a releasing agent, wherein the binder resin contains a crystalline polyester resin;

an endothermic peak top temperature of the electrostatic latent image developing toner is 70° C. or more measured with differential scanning calorimetry (DSC) in a heating-up period of the electrostatic latent image developing toner; and a heat value $\Delta H_c(L)$ is 15% or less with respect to a heat value $\Delta H_c$, wherein the heat value $\Delta H_c(L)$ is a heat value in the range of (an exothermic peak top temperature $r_c$−7° C.) or less; and the heat value $\Delta H_c$ is a heat value of the total exothermic peak measured with DSC in a heating-down period of the electrostatic latent image developing toner.

2. The electrostatic latent image developing toner described in the embodiment 1, wherein the releasing agent contains an aliphatic acid ester wax having 30 to 72 carbon atoms.

3. The electrostatic latent image developing toner described in the embodiments 1 or 2, wherein the releasing agent contains a hydrocarbon wax.

4. The electrostatic latent image developing toner described in any one of the embodiments 1 to 3, wherein the releasing agent contains a hydrocarbon wax and an aliphatic acid ester wax having 30 to 72 carbon atoms.

5. The electrostatic latent image developing toner described in the embodiments 3 or 4, wherein the hydrocarbon wax contains a branched structure.

6. The electrostatic latent image developing toner described in any one of the embodiments 1 to 5, wherein the exothermic peak top temperature $r_c$ is in the range of 50 to 80° C., the exothermic peak top temperature being measured with DSC in a heating-down period of the toner.

7. The electrostatic latent image developing toner described in any one of the embodiments 1 to 6, wherein the exothermic top temperature $r_c$ is in the range of 60 to 75° C., the exothermic peak top temperature being measured with DSC in a heating-down period of the toner.

8. The electrostatic latent image developing toner described in any one of the embodiments 1 to 7, wherein the crystalline polyester resin contained in the binder resin is a hybrid crystalline polyester resin.

By any one of the above-described embodiments of the present invention, it is possible to provide an electrostatic latent image developing toner excellent in low-temperature fixability without producing an image noise even after keeping it for a long period of time under the conditions of high temperature and high humidity.

A formation mechanism or an action mechanism of the effects of the present invention is not clearly identified, but it is supposed as follows.

A crystallization peak (an exothermic peak) of a toner is originated from the releasing agent having a crystallization property and crystallization of the crystalline resin. Here, the exothermic peak designates a peak obtained from the exothermic curve in a heating-down period of the toner measured with DSC. In addition, the exothermic curve in a heating-down period of the toner measured with DSC represents a heat generation in the cooling step after heating the toner to the neighborhood of the melting point of the releasing agent and the crystalline resin in the toner production.

A releasing agent and a crystalline resin each respectively have intrinsic crystallization range in each constitution. In general, a releasing agent and a crystalline resin will form toner particles by being used in combination of the toner constituting components such as a binder resin component other than the crystalline resin. When this kind of toner is produced, the releasing agent and the crystalline resin are cooled after heat-mixing with the binder resin component other than the crystalline resin. In the course of this cooling step, the above-described toner constituting components including the releasing agent and the crystalline resin mutually affect the crystallization of each component. It may change the shape of a crystallization peak.

The present inventors found out the following. The tailing portion in the low temperature side of the crystallization peak corresponds to the portion which is difficult to be crystallized during the cooling step of the toner production. Further, the present inventors considered the following. When the polymer crystalline resin is added to the toner particles, the releasing agent will be also difficult to be crystallized. When the toner containing an unstable crystallizing component is stored under high-temperature and high-humidity conditions for a long period of time, crystallization of the unstable crystallizing component will proceeds, and the crystallized domain will become large. As a result, the crystallized component bleeds.

The present inventors made investigation based on the above-described consideration. As a result, the present inventors found that contamination of the members by bleed out of the releasing agent under high-temperature and high-humidity conditions to produce image noise may be reduced by making the ratio of the tailing portion in the low-temperature side of the crystallization peak to be a predetermined value or less.

Specifically, a heat value $\Delta H_c(L)$, which is a heat value in the range of (an exothermic peak top temperature $r_c$−7° C.) or less, is made to be 15% or less with respect to a heat value $\Delta H_c$, which is a heat value of the total exothermic peak measured with DSC in a heating-down period of the toner. By this, an amount of an unstable crystallizing component will be reduced. Consequently, the bleed out of the releasing agent will be inhibited. Thus, the present invention has been found.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DESCRIPTION OF THE PREFERRED EMBODIMENTS

Figure 1:
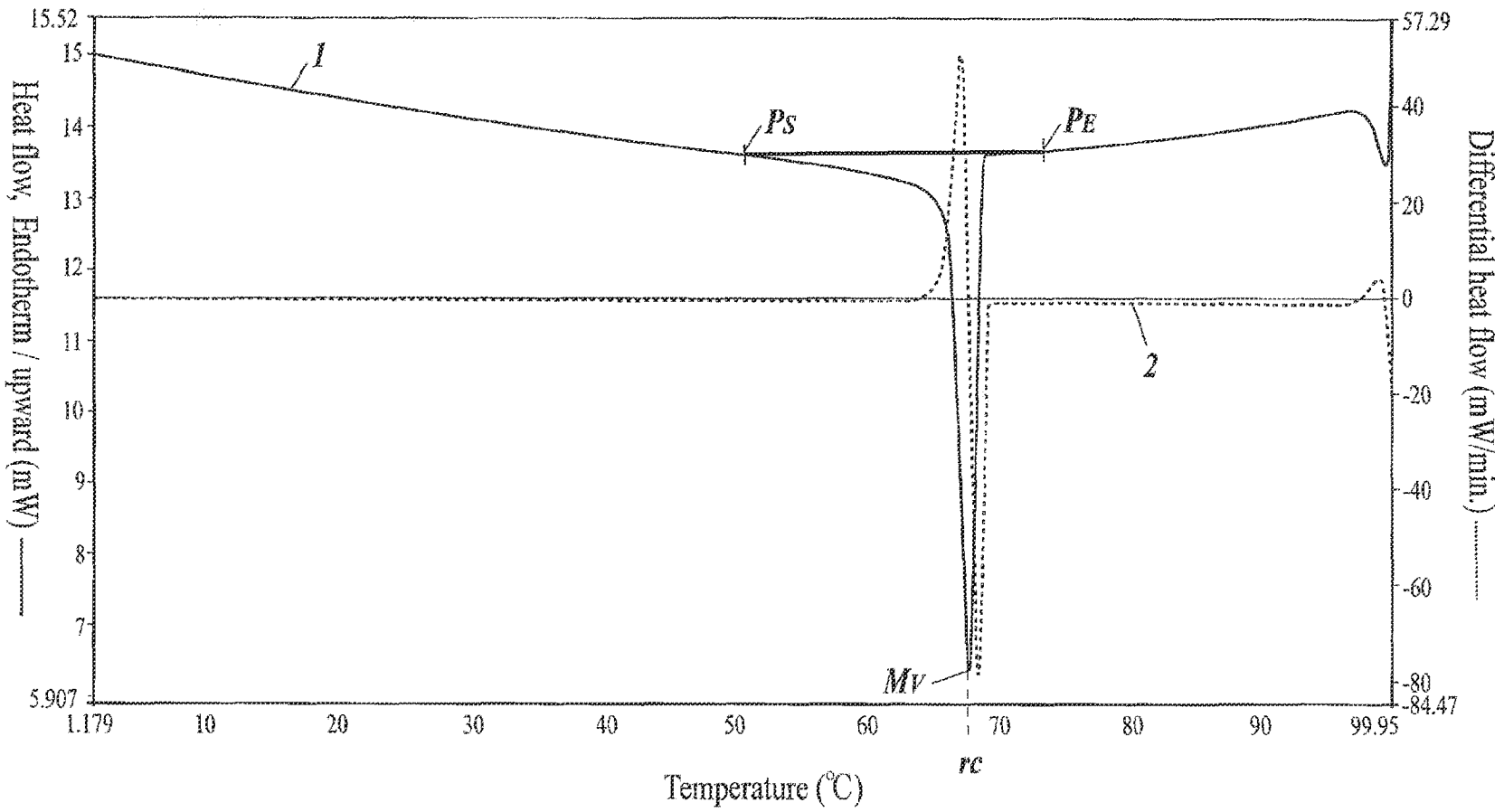
FIG. 1 is a graph indicating an example an exothermic curve and its differential curve in a heating-down period of the toner measured with DSC.

Hereinafter, one or more embodiments of the present invention will be described with reference to the drawings. However, the scope of the invention is not limited to the disclosed embodiments.

An electrostatic latent image developing toner of the present invention comprises: a binder resin; and a releasing agent. The toner is characterized in that: the binder resin contains a crystalline polyester resin; an endothermic peak top temperature of the electrostatic latent image developing toner is 70° C. or more measured with differential scanning calorimetry (DSC) in a heating-up period of the toner; and a heat value $\Delta H_c(L)$, which is a heat value in the range of (an exothermic peak top temperature $r_c$−7° C.) or less, is 15% or less with respect to a heat value $\Delta H_c$, which is a heat value of the total exothermic peak measured with DSC in a heating-down period of the toner. The above-described technical feature is common to the inventions relating to the embodiments of the present invention. By this feature, the present invention can provide an electrostatic latent image developing toner which is excellent in low-temperature fixing fixability and does not produce image noise after keeping it for a long period of time under the condition of high temperature and high humidity.

In the present invention, it is preferable that the releasing agent contains an aliphatic acid ester wax having 30 to 72 carbon atoms. By this, it is possible to suitably reduce the value $\Delta H_c(L)$. Consequently, the effect of the present invention will be suitably obtained.

In the present invention, it is preferable that the releasing agent contains a hydrocarbon wax. In particular, it is preferable that the hydrocarbon wax contains a branched structure in the molecule. By this, the crystallization will be promoted. As a result, the value $\Delta H_c(L)$ may be suitably reduced. Consequently, the effect of the present invention will be suitably obtained.

In the present invention, it is preferable that the releasing agent contains a hydrocarbon wax and an aliphatic acid ester wax having 30 to 72 carbon atoms. By this, the crystallization will be promoted compared with the case in which each component is contained singly. As a result, the value $\Delta H_c(L)$ may be suitably reduced. Further, the crystallization temperature may be easily made in a preferable range (50 to 80° C.), and the low-temperature fixability will be improved.

In the present invention, it is preferable that an exothermic peak top temperature $r_c$ is in the range of 50 to 80° C. measured with DSC in a heating-down period of the toner. It is more preferable that the exothermic peak top temperature $r_c$ is in the range of 60 to 75° C. measured with DSC in a heating-down period of the toner. By this, the toner will be easily crystallized, the value $\Delta H_c(L)$ may be suitably reduced, and the low-temperature fixability will be improved.

It is preferable that a hybrid crystalline polyester resin is contained in the toner as a crystalline polyester resin for the purpose of further improving the low-temperature fixability. By this, the low-temperature fixability of the toner is improved and the bleed out will be restrained.

The present invention and the constitution elements thereof, as well as configurations and embodiments, will be detailed in the following. In the present description, when two figures are used to indicate a range of value before and after "to", these figures are included in the range as a lowest limit value and an upper limit value.

<<General Outline of Electrostatic Latent Image Developing Toner>>

An electrostatic latent image developing toner of the present invention is characterized in the following.

The toner comprises: a binder resin; and a releasing agent, wherein the binder resin contains a crystalline polyester resin; an endothermic peak top temperature of the electrostatic latent image developing toner is 70° C. or more measured with differential scanning calorimetry (DSC) in a heating-up period of the toner; and a heat value $\Delta H_c(L)$, which is a heat value in the range of (an exothermic peak top temperature $r_c$−7° C.) or less, is 15% or less with respect to a heat value $\Delta H_c$, which is a heat value of the total exothermic peak measured with DSC in a heating-down period of the toner.

[Electrostatic Latent Image Developing Toner]

An electrostatic latent image developing toner of the present invention is preferably an aggregate of toner particles or toner mother particles.

Here, although the toner particles are preferably made of the toner mother particles added with an external additive, the toner mother particles may be used as toner particles without any additives.

In the present invention, it is preferable that the electrostatic latent image developing toner is composed of a binder resin and a releasing agent by making incorporating the binder resin and the releasing agent into the toner mother particles. In addition, in the present invention, toner mother particle, toner particles, and a toner may be simply called as "a toner" when there is no need to distinguish them.

An electrostatic latent image developing toner of the present invention has an endothermic peak top temperature of the electrostatic latent image developing toner of 70° C. or more measured with DSC in a heating-up period of the toner. Further, a heat value $\Delta H_c(L)$, which is a heat value in the range of (an exothermic peak top temperature $r_c$−7° C.) or less, is 15% or less with respect to a heat value $\Delta H_c$, which is a heat value of the total exothermic peak measured with DSC in a heating-down period of the toner. A preferable $\Delta H_c(L)$ value is 10% or less, and more preferably, it is 7% or less. When the value of $\Delta H_c(L)$ is smaller, the bleed out of the releasing agent will be more reduced. As described above, a small $\Delta H_c(L)$ value is preferable, and a preferable under limit is 0%. However, it is assumed that a practical under limit is about 3%.

As a method of achieving the relationship of: an endothermic peak top temperature of the electrostatic latent image developing toner measured with DSC in a heating-up period of the toner; a heat value $\Delta H_c$, which is a heat value of the total exothermic peak measured with DSC in a heating-down period of the toner; and a heat value $\Delta H_c(L)$, which is a heat value in the range of (an exothermic peak top temperature $r_c$−7° C.) or less, the following methods are efficient to promote crystallization: by combination of a releasing agent and a crystalline resin (crystalline polyester resin) (specifically, to increase the difference of crystallization, or to reduce the interaction effect by the difference of affinity such as polarity); by combination of a releasing agent and a binder resin (specifically, to reduce the interaction effect by the difference of affinity such as polarity, or to control Tg or molecular weight of the binder resin); and by co-using a plurality of binder resins (specifically, to use a hydrocarbon wax. in particular a branched paraffin wax with an aliphatic acid ester wax).

By the above-described methods, the releasing agent and the crystalline resin will not inhibit respective crystallization. They will be crystallized independently, or they will be easily crystallized. As a result, it may be achieved the relationship between a heat value $\Delta H_c$, which is a heat value of the total exothermic peak; and a heat value $\Delta H_c(L)$, which is a heat value in the range of (an exothermic peak top temperature $r_c$−7° C.) or less.

[Measurement of Heat Value $\Delta H_c$ of Total Exothermic Peak]

5 mg of measuring sample is sealed in an aluminum pan (KIT NO. B0143013) and it is set to a sample holder of a thermal analysis instrument "Diamond DSC" (made by PerkinElmer Inc.). The temperature is changed in the order of heating-cooling-heating. In the first and the second heating step, the temperature is increased from 0° C. to 100° C. at a heating rate of 10° C./min, then the temperature is kept at 100° C. for 1 minute. In the cooling step, the temperature is decreased from 100° C. to 0° C. at a cooling rate of 10° C./min. Then the temperature is kept at 0° C. for 1 minute.

The temperature of the endothermic peak top in the endothermic curve obtained in the temperature increasing (heating) step of the toner is measured as an endothermic peak top temperature. A heat value of the total exothermic peak in in the endothermic curve obtained in the cooling step is measured as $\Delta H_c$. The temperature of an exothermic peak top is measured as an exothermic peak top temperature $r_c$, and a heat value in the range of (an exothermic peak top temperature $r_c$−7° C.) to the end of the exothermic peak is measured as a heat value $\Delta H_c(L)$.

[Definition of Exothermic Peak Top Temperature $r_c$ in a Heating-Down Period]

An exothermic peak top temperature $r_c$ in a heating-down period of the toner will be described by referring to FIGS. 1 to 3.

A curve 1 in FIG. 1 is an exothermic curve with DSC in a heating-down period of the toner. A curve 2 is a differential curve of the curve 1 (hereafter, the curve 2 may be called as "differential curve 2").

In the present invention, in the curve 1, a starting point and an end point of an exothermic peak are defined by a starting point and an end point of the change of the slope of the differential curve 2.

Figure 2:
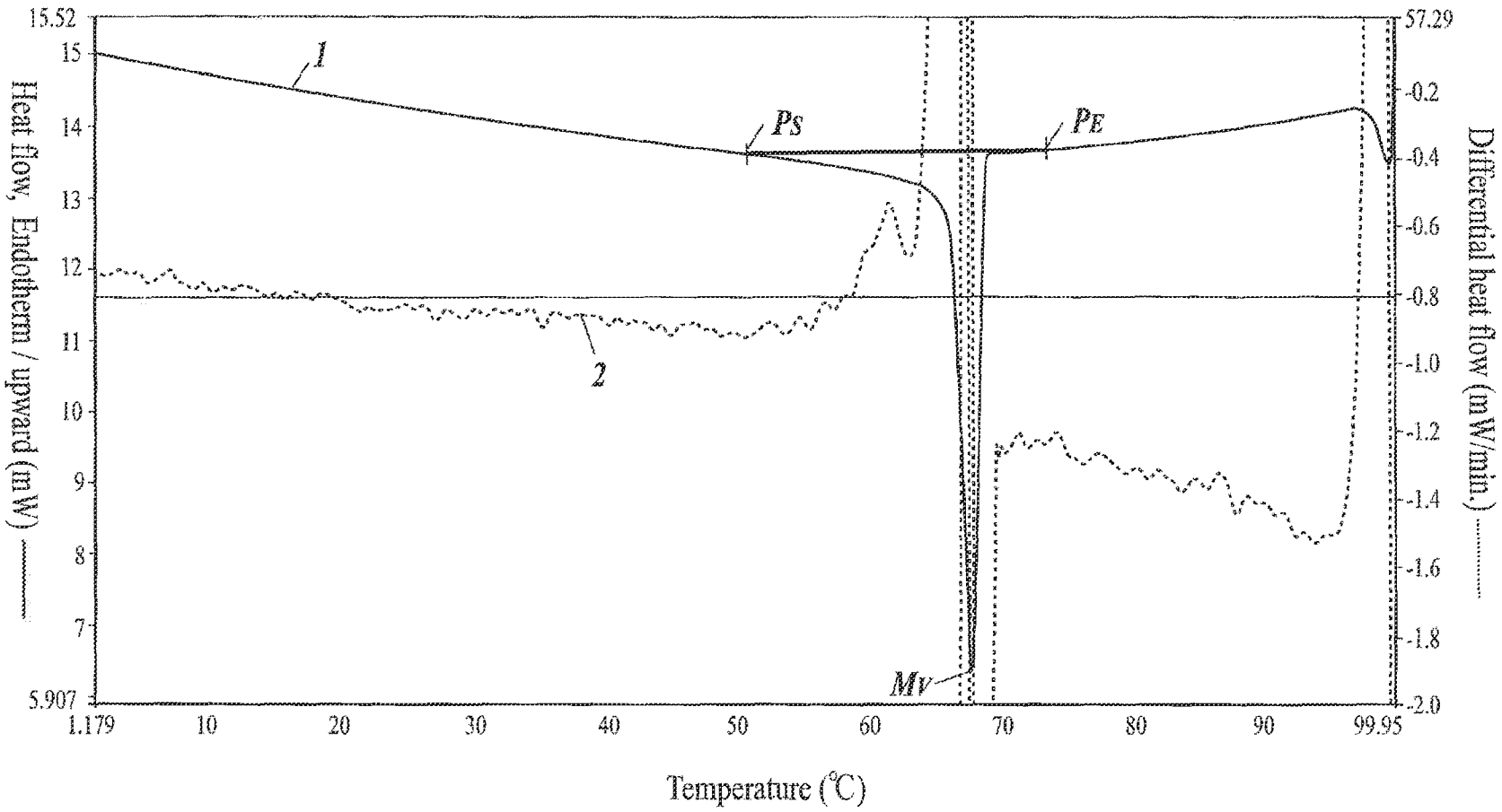
FIG. 2 is a graph indicating an example an exothermic curve and its differential curve in a heating-down period of the toner measured with DSC.
Figure 3:
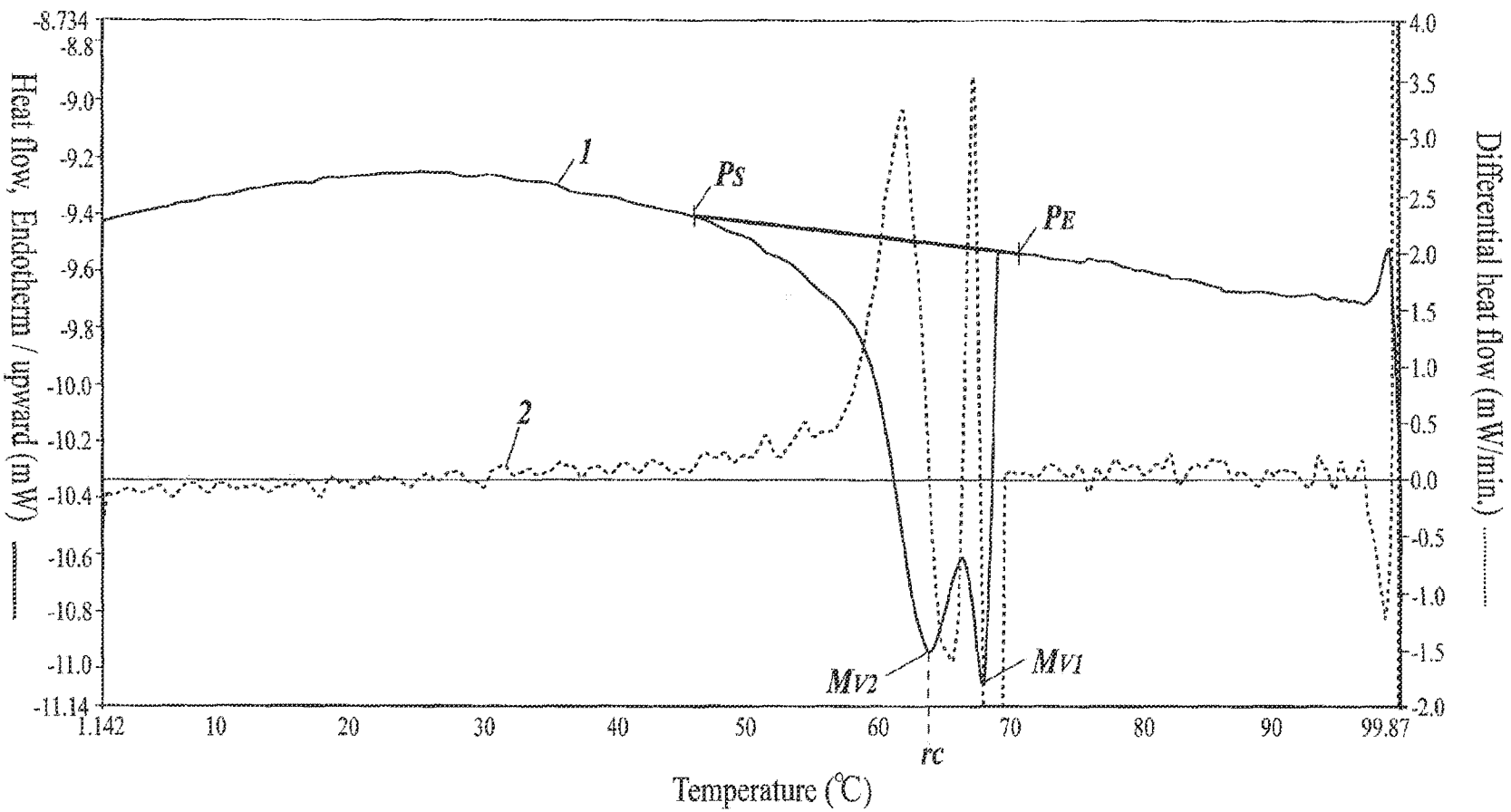
FIG. 3 is a graph indicating another example an exothermic curve and its differential curve in a heating-down period of the toner measured with DSC.

FIG. 2 is an enlarged drawing of the curve 2. A starting point of the change of the slope of the differential curve 2 (a neighborhood of 51° C. in the case of FIGS. 1 and 2), and an end point (a neighborhood of 73° C. in the case of FIGS. 1 and 2) are respectively defines as a starting point $P_s$ and an endpoint $P_E$ of an exothermic peak in the curve 1. An exothermic peak top temperature $r_c$ is defined as a temperature of a local minimum point $M_V$ in the range of the starting point $P_s$ and the end point $P_E$ of the peak as defined above. When there are a plurality of local minimum points as illustrated in FIG. 3, an exothermic peak top temperature is attributed to the peak having a lowest temperature among the local minimum points having an intensity of ⅓ or more of the local minimum point having a largest intensity. This temperature is decided to be an exothermic peak top temperature $r_c$. Specifically, in the case of FIG. 3, although a local minimum point having a largest intensity $MV_1$ exists at a neighborhood of 68° C., an exothermic peak top temperature $r_c$ of the present invention is made to be a lower temperature (a neighborhood of 64° C.) of a local minimum point $MV_2$.

(Preferable Exothermic Peak Top Temperature $r_0$)

It is preferable that an exothermic peak top temperature $r_c$ in the heating-down period measured with DSC of the electrostatic latent image developing toner is in the range of 50 to 80° C., more preferably, it is in the range of 60 to 75° C. When the exothermic peak top temperature $r_c$ is 50° C. or more, the amount of the crystallizing component during production of the toner will be increased. As a result, a heat value $\Delta H_c(L)$ will become small. Further, when the exothermic peak top temperature is 80° C. or less, it is efficient to obtain low-temperature fixability.

(Definition of Endothermic Peak Top Temperature in Heating-Up Period)

An endothermic peak top temperature in a heating-up period of the toner is defined by using an endothermic curve in a first heating-up period with DSC and a differential curve of the endothermic curve. It is defined in the same way as defining the exothermic peak top temperature $r_c$ in the heating-down period of the toner.

Namely, an endothermic peak top temperature is a temperature of a local maximum point in the range from a starting point to an end point of a peak, which are defined as in the case of an exothermic peak top temperature $r_c$ in the heating-down period of the toner. When there are a plurality of local maximum points, an endothermic peak top temperature is attributed to the peak having a largest intensity among the local maximum points having an intensity of ⅓ or more of the local maximum point having a largest intensity.

[Binder Resin]

A toner according to the present invention contains at least a crystalline polyester resin as a binder resin. The binder resin may contain an amorphous resin. Further, a known resin may be included within the scope of not inhibiting the effects of the present invention.

[Amorphous Resin]

An amorphous resin may be one kind or plural kinds. Examples of an amorphous resin include: a vinyl resin, a urethane resin, a urea resin and an amorphous polyester resin such as a styrene-acrylic modified polyester resin. Among them, from the viewpoint of easily controlling thermal plasticity, a vinyl resin is preferably used.

(Vinyl Resin)

The above-described vinyl resin is a polymer of a vinyl compound. Examples thereof are: an acrylic acid ester resin, a styrene-acrylic acid ester resin, and an ethylene-vinyl acetate resin. Among them, a styrene-acrylic acid ester resin (styrene-acrylic resin) is preferably used from the viewpoint of plasticity during the heat-fixing step.

(Styrene-Acrylic Resin)

A styrene-acrylic resin is formed by an addition polymerization with a styrene monomer and a (meth)acrylic acid ester monomer. A styrene monomer includes: styrene represented by $CH_2{=}CH{-}C_6H_5$, and a styrene derivative containing a known side chain or a known functional group in the molecule.

((Meth)Acrylic Acid Ester Monomer)

A (meth)acrylic ester monomer is an acrylic acid ester or a methacrylic acid ester represented by $CH(R_a){=}CHCO{-}OR_b$ ($R_a$ is a hydrogen atom or a methyl group; and $R_b$ is an alkyl group of 1 to 24 carbon atoms). In addition, a (meth) acrylic acid ester monomer includes an acrylic acid ester derivative or a methacrylic acid ester derivative containing a known side chain or a known functional group in the molecule.

Examples of a (meth)acrylic acid ester monomer include the following compounds.

Acrylic acid ester monomers such as: methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate.

Methacrylic acid ester monomer such as: methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

In the present specification, "a (meth) acrylic acid ester monomer" is a general name of "an acrylic acid ester monomer" and "a methacrylic acid ester monomer". This term designates one of or both of the monomers.

The above-described (meth) acrylic acid ester monomer may be one kind or more kinds. Example co-polymers are formed: using a styrene monomer and 2 or more kinds of acrylic acid ester monomers; using a styrene monomer and 2 or more kinds of methacrylic acid ester monomers; and using a styrene monomer, an acrylic acid ester monomer, and a methacrylic acid ester monomer.

(Styrene Monomer)

Examples of a styrene monomer include: styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene.

(Preferable Constitution of Styrene-Acrylic Resin)

From the viewpoint of controlling the plasticity of the above-described styrene-acrylic resin, a content of the constituting component derived from the styrene monomer in the styrene-acrylic resin is preferably in the range of 40 to 90 mass %. Further, a content of the constituting component derived from the (meth)acrylic acid ester monomer in the styrene-acrylic resin is preferably in the range of 10 to 60 mass %.

(Other Monomer)

The styrene-acrylic resin may further contain a constituting component derived from other monomer than the styrene monomer and the (meth)acrylic acid ester monomer. The other monomer is preferably a compound which forms an ester bond with a hydroxy group (—OH) derived from a polyhydric alcohol or a carboxy group (—COOH) derived from a polycarboxylic acid It is preferable that the styrene-acrylic resin is able to make addition polymerization with the styrene monomer and the (meth)acrylic acid ester monomer. Moreover, it is preferable and that the styrene-acrylic resin is a polymer which is formed by further polymerization with a compound having a carboxy group and a hydroxy group (bireactive compound).

The bireactive compounds of the present invention contain the following. Compounds containing a carboxy group such as: acrylic acid, methacrylic acid, maleic acid, itaconic acid, cinnamic acid, fumaric acid, monoalkyl maleate, and monoalkyl itaconate. Compounds containing a hydroxy group such as: 2-hydroxyethyl (meth) acrylate, 2-hydroxypropyl (meth) acrylate, 3-hydroxypropyl (meth) acrylate, 2-hydroxybutyl (meth)acrylate, 3-hydroxybutyl (meth)acrylate, 4-hydroxybutyl (meth) acrylate, and polyethyleneglycol mono(meth)acrylate.

(Preferable Content of Constituting Unit Derived from Bireactive Compound)

A preferable content of the constituting unit derived from the above-described bireactive compound in the styrene-acrylic resin is in the range of 0.5 to 20 mass %.

(Synthetic Method of Styrene-Acrylic Resin)

The styrene-acrylic resin may be synthesized by polymerization of the monomers with a known oil-soluble or water-soluble polymerization initiator. Examples of an oil-soluble polymerization initiator includes: an azo-type or diazo-type polymerization initiator and a peroxide-type polymerization initiator.

(Azo-Type or Dizao-Type Polymerization Initiator)

Examples of an azo-type or dizao-type polymerization initiator include: 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

(Peroxide-Type Polymerization Initiator)

Examples of a peroxide-type polymerization initiator include: benzoyl peroxide, methyl ethyl ketone peroxide, diisopropyl peroxy carbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl) propane, and tris-(t-butylperoxy)triazine.

(Water-Soluble Radical Polymerization Initiator)

When resin particles of a styrene-acrylic resin are synthesized with an emulsion polymerization method, a water-soluble radical polymerization initiator may be used as a polymerization initiator. Examples of a water-soluble radical polymerization initiator include: persulfates such as potassium persulfate, and ammonium persulfate; azobisaminodipropane acetate salt; azobiscyanovaleric acid and its salt; and hydrogen peroxide.

(Preferable Weight Average Molecular Weight of Amorphous Resin)

From the viewpoint of easily controlling its plasticity, it is preferable that the amorphous resin has a weight average molecular weight (Mw) in the range of 5,000 to 150,000, more preferably, in the range of 10,000 to 70,000.

[Crystalline Resin]

In the present invention, a crystalline resin refers to a resin that exhibits a clear endothermic peak in an endothermic curve obtained by measurement with DSC of the crystalline resin or the toner. The endothermic change is not a stepwise change. Here, "a clear endothermic peak" designates a peak having a half bandwidth within 15° C. in an endothermic curve obtained by measurement with DSC under the condition of a temperature raising rate of 10° C./min.

A crystalline polyester resin designates a polyester resin among the crystalline resins having the above-described property.

In the present invention, a binder resin contains at least a crystalline polyester resin. Other crystalline resin may be used other than the crystalline polyester resin within the range that does not inhibit the appearance of the effect of the present invention. Such crystalline resins are not limited in particular. A known resin may be used singly, or plural kinds may be used.

(Melting Point of Crystalline Polyester Resin)

A melting point ($T_m$) of the above-described crystalline polyester resin is preferably in the range of 50 to 90° C., more preferably in the range of 60 to 80° C. from the viewpoint of obtaining sufficient low-temperature fixability and high-temperature storage stability.

(Measuring Method of Melting Point)

The melting point of a binder resin may be measured with DSC by using a thermal analysis instrument "Diamond DSC" (PerkinElmer Inc.). Specific measurement is done as follows.

First, 0.5 mg of measuring sample is sealed in an aluminum pan (KIT NO. B0143013) and it is set to a sample holder of the instrument. The temperature is changed in the order of heating-cooling-heating. In the first and the second heating step, the temperature is increased from room temperature (25° C.) to 150° C. at a heating rate of 10° C./min, then the temperature is kept at 150° C. for 5 minutes. In the cooling step, the temperature is decreased from 150° C. to 0° C. at a cooling rate of 10° C./min. Then the temperature is kept at 0° C. for 5 minutes. The peak top temperature of the endothermic peak in the endothermic curve obtained in the second heating step is taken as a melting point ($T_m$).

(Preferable Weight Average Molecular Weight and Preferable Number Average Molecular Weight of Crystalline Polyester Resin)

From the viewpoint of achieving low-temperature fixability and stable glossiness of the final image, it is preferable that the crystalline polyester resin has a weight average molecular weight (Mw) in the range of 5,000 to 50,000, and a number average molecular weight (Mn) in the range of 2,000 to 10,000.

(Measuring Method of Weight Average Molecular Weight and Number Average Molecular Weight)

A weight average molecular weight (Mw) and a number average molecular weight (Mn) of the sample may be determined from the molecular weight distribution obtained by gel permeation chromatography (GPC) as indicted in the following.

A measuring sample is dissolved in tetrahydrofuran to a concentration of 1 mg/mL by a treatment with an ultrasonic disperser at room temperature for 5 minutes. The solution is then treated with a membrane filter having a pore size of 0.2 μm to obtain a sample solution.

A GPC device "HLC-8120 GPC" (TOSOH Corp.) and a column set "TSK guard column+3×TSK gel Super HZM-M" (TOSOH Corp.) are used. The column temperature is held at 40° C., and tetrahydrofuran (THF) is supplied at a flow rate of 0.2 mL/min as a carrier solvent. An aliquot (10 μL) of the sample solution is injected into the device along with the carrier solvent and the sample is detected by means of a refractive index (RI) detector. The molecular weight distribution of the sample is calculated by using a calibration curve, which is determined by using standard monodisperse polystyrene particles.

(Content of Crystalline Resin in Toner Mother Particles)

A preferable content of crystalline resin in toner mother particles is in the range of 5 to 20 mass % from the viewpoint of achieving an excellent low-temperature fixability and a transfer property under high-temperature and high-humidity conditions. When the content is 5 mass % or more, a sufficient low-temperature fixability of the formed toner image will be obtained. When the content is 20 mass % or less, a sufficient transfer property will be obtained.

<Constitution of Crystalline Polyester Resin>

A crystalline polyester resin may be obtained by a polycondensation reaction of a carboxylic acid having two valences or more (polycarboxylic acid) with an alcohol having two valences or more (polyhydric alcohol)

(Dicarboxylic Acid)

Examples of a polycarboxylic acid include a dicarboxylic acid. The dicarboxylic acid may be used singly, or may be used plural kinds. A preferable dicarboxylic acid is an aliphatic dicarboxylic acid. It may further contain an aromatic dicarboxylic acid. A straight chain aliphatic dicarboxylic acid is preferably used from the viewpoint of increasing crystalline property of the crystalline polyester resin.

(Aliphatic Dicarboxylic Acid)

Examples of an aliphatic dicarboxylic acid include: oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid (dodecanedioic dicarboxylic acid), 1,13-tridecane dicarboxylic acid, 1,14-tetradecane dicarboxylic acid, 1,16-hexadecane dicarboxylic acid, and 1,18-octadecane dicarboxylic carboxylic acid. It can be used a low alkyl ester or an acid anhydride of these compounds.

Among the above-described aliphatic dicarboxylic acids, preferable are aliphatic dicarboxylic acids having 6 to 16 carbon atoms. More preferable are aliphatic dicarboxylic acids having 10 to 14 carbon atoms.

(Aromatic Dicarboxylic Acid)

Examples of an aromatic dicarboxylic acid include: terephthalic acid, isophthalic acid, orthophthalic acid, t-butyl isophthalic acid, 2,6-naphthalene dicarboxylic acid, and 4,4'-biphenyl dicarboxylic acid. Among these, from the viewpoint of easy availability and easy emulsification, it is preferable to use: terephthalic acid, isophthalic acid and t-butyl isophthalic acid.

(Preferable Content of Dicarboxylic Acid in Crystalline Polyester Resin)

From the viewpoint of obtaining a sufficient crystallizing property of a crystalline polyester resin, a preferable content of a constituting unit derived from an aliphatic dicarboxylic acid with respect to a constituting unit derived from the dicarboxylic acid in the crystalline polyester resin is 50 mole % or more, more preferably 70 mole % or more, still more preferably 80 mole % or more, and most preferably 100 mole %.

(Diol)

As examples of the above-described polyhydric alcohol, diols are included. The diol may be used alone, or may be used in combination of two or more kinds. It is preferable to use an aliphatic diol. It may be included a diol other than an aliphatic diol when needed. A straight chain type aliphatic diol is preferably used, since it will have an advantage of improving crystalline property of a crystalline polyester resin.

(Aliphatic Diol)

Examples of an aliphatic diol are: ethylene glycol, 1,3-propanediol, 1,4-butanediol, 1,5-pentanediol, 1,6-hexanediol, 1,7-heptanediol, 1,8-octanediol, 1,9-nonanediol, 1,10-dodecanediol, 1,11-undecanediol, 1,12-dodecanediol, 1,13-tridecanediol, 1,14-tetradecanediol, 1,18-octadecanediol, and 1,20-eicosandiol.

Among aliphatic diols, preferable diol are aliphatic diols of 2 to 12 carbon atoms. More preferable diols are aliphatic diols of 4 to 6 carbon atoms.

(Other Diol)

Diols other than aliphatic diols are: diols having a double bond; and diols having a sulfonic acid group. Specific diols having a double bond are: 2-butene-1,4-diol, 3-butene-1,6-diol, and 4-butene-1,8-diol.

(Preferable Content of Aliphatic Diol in Crystalline Polyester Resin)

From the viewpoint of obtaining excellent low-temperature fixability of the toner and increasing glossiness of the obtained final image, a preferable content of a constituting unit derived from an aliphatic diol with respect to a constituting unit derived from the diol in the crystalline polyester resin is 50 mole % or more, more preferably 70 mole % or more, still more preferably 80 mole % or more, and most preferably 100 mole %.

(Preferable Ratio of Diol and Dicarboxylic Acid)

Regarding the ratio of the diol component and the polycarboxylic acid component in the monomers for a crystalline polyester resin, it is preferable that the equivalent ratio of the hydroxy groups [OH] of the diol component to the carboxy groups [COOH] of the polycarboxylic acid component ([OH]/[COOH]) is in the range of 2.0/1.0 to 1.0/2.0, more preferably in the range of 1.5/1.0 to 1.0/1.5, still more preferably in the range of 1.3/1.0 to 1.0/1.3.

(Synthesis of Crystalline Polyester Resin)

The crystalline polyester resin may be sythesized by polycondensation (esterification) of the above-described polycarboxylic acid and polyhydric alcohol with a known esterification catalyst.

(Catalysts which May be Used for Synthesizing Crystalline Polyester Resin)

Usable catalysts for synthesizing a crystalline polyester resin of the present invention may be one kind, or they may be a combination of two or more kinds. Examples thereof are: alkali metal compounds made of sodium and lithium; alkali earth metal compounds made of magnesium and calcium; metal compounds made of metals such as aluminum, zinc, manganese, antimony, titanium, tin, zirconium, and germanium; phosphorous acid compounds, phosphoric acid compounds, and amine compounds.

Specific examples of a tin compound are: dibutyltin oxide, tin octylate, tin dioctylate, and salts thereof.

Specific examples of a titanium compound are: titanium alkoxides such as tetra-n-butyl titanate, tetraisopropyl titanate, tetramethyl titanate, and tetrastearyl titanate; titanium acylates such as polyhydroxy titanium stearate; and titanium chelates titanium tetraacetylacetonate, titanium lactate, and titanium triethanolaminate.

A specific example of a germanium compound is germanium dioxide.

Specific examples of an aluminum compound are: and oxide such as poly aluminum hydroxide, aluminum alkoxide, and tributyl aluminate.

(Preferable Polymerization Temperature of Crystalline Polyester Resin)

A preferable polymerization temperature of crystalline polyester resin is in the range of 150 to 250° C. A preferable polymerization term is in the range of 0.5 to 10 hours. The inside pressure of the reaction system during polymerization may be reduced when needed.

<Hybrid Crystalline Polyester Resin>

A hybrid crystalline polyester resin (hereafter, it may be also simply called as "a hybrid resin") may be included as a crystalline polyester resin. By incorporating a hybrid crystalline polyester resin, the affinity with the co-used amorphous resin is improved. As a result, the low-temperature fixability of the toner is improved. Further, since the dispersing property of the crystalline resin in the toner is improved, it may be restrained bleed out.

A hybrid resin may be used singly, or plural kinds may be used. The total amount of the crystalline polyester resin may be replaced with a hybrid resin. A partial amount of the crystalline polyester resin may be replaced with a hybrid resin (it may be co-used).

A hybrid resin designates a resin composed of a crystalline polyester polymer segment and an amorphous polymer segment, both being chemically bonded with each other. The crystalline polyester polymer segment indicates a portion derived from the crystalline polyester resin. That is, it indicates a molecular chain having the same chemical structure that constitutes the crystalline polyester resin. The amorphous polymer segment indicates a portion derived from the amorphous resin. That is, it indicates a molecular chain having the same chemical structure that constitutes the amorphous resin.

(Preferable Weight Average Molecular Weight (Mw) of Hybrid Resin)

A weight average molecular weight (Mw) of the hybrid resin of the present invention is preferably in the range of 5,000 to 100,000, more preferably in the range of 7,000 to 50,000, and still more preferably in the range of 8,000 to 20,000 from the viewpoint of securely obtaining a good balance of sufficient low-temperature fixability and highly prolonged storage stability.

By making the weight average molecular weight (Mw) of the hybrid resin to be 100,000 or less, sufficient low-temperature fixability may be obtained. On the other hand, by making the weight average molecular weight (Mw) of the hybrid resin to be 5,000 or more, exceeded mutual dissolving of the hybrid resin and the amorphous resin may be controlled, and an image failure caused by coalition of toners may be effectively prevented.

(Crystalline Polyester Polymer Segment)

A crystalline polyester polymer segment may be a resin of a crystalline polyester polymer segment copolymerized with other component in the main chain. It may be a resin having a main chain of other component copolymerized with a crystalline polyester polymer segment. The crystalline polyester polymer segment may be synthesized in the same manner as synthesis of the crystalline polyester resin with a polycarboxylic acid and a polyhydric alcohol.

(Content of Crystalline Polyester Polymer Segment in Hybrid Resin)

A content of a crystalline polyester polymer segment in a hybrid resin is preferably in the range of 80 to 98 mass %, more preferably in the range of 90 to 95 mass %, and still more preferably in the range of 91 to 93 mass %, from the viewpoint of giving sufficient crystallization property to the hybrid resin. The constituting component and the content of each polymer segment in the hybrid resin (or in the toner) may be determined with a known analytic method such as an NMR measurement, or a measurement of a methylation reaction pyrolysis gas chromatography/mass spectrography (Py-GC/MS).

(Preferable Embodiment of Crystalline Polyester Polymer Segment)

It is preferable that a crystalline polyester polymer segment further contains a monomer having an unsaturated bond from the viewpoint of incorporating a chemical bonding site with an amorphous polymer segment in the crystalline polyester polymer segment. A monomer having an unsaturated bond is a polyhydric alcohol having a double bond, for example. Examples of thereof include: polycarboxylic acids having a double bond such as methylene succinic acid, fumaric acid, maleic acid, 3-hexenedioic acid, and 3-octenedioic acid; 2-butene-1,4-diol, 3-butene-1,6-diol and 4-butene-1,8-diol. A preferable content of a constituting unit derived from a monomer having the above-described unsaturated bond in the crystalline polyester polymer segment is in the range of 0.5 to 20 mass %.

The hybrid resin of the present invention may be any form of a block copolymer or a graft copolymer. When the hybrid resin is a graft copolymer, it is easy to control the orientation of the crystalline polyester polymer segment. Consequently, it is possible to give a sufficient crystalline property to the hybrid resin.

It is preferable that a crystalline polyester polymer segment is grafted to a main chain of an amorphous polymer segment. Namely, it is preferable that the hybrid resin is a graft copolymer containing the amorphous polymer segment as a main chain and the crystalline polyester polymer segment as a side chain.

(Incorporation of Functional Group)

The hybrid resin of the present invention may incorporate functional groups such as a sulfonic acid group, a carboxy group, and a urethane group. The incorporation of the functional groups may be in the crystalline polyester polymer segment or may be in the amorphous polymer segment.

(Amorphous Polymer Segment)

An amorphous polymer segment may increase an affinity of an amorphous resin and a hybrid resin that constitute the binder resin. By this, the hybrid resin will be easily included in the amorphous resin. Thus, homogeneous charging of the toner will be improved. The constituting component and the content of the amorphous polymer segment in the hybrid resin (or in the toner) may be determined with a known analytic method such as an NMR measurement, or a measurement of a methylation reaction pyrolysis gas chromatography/mass spectrography (Py-GC/MS).

It is preferable that an amorphous polymer segment has a glass transition temperature (Tg) in the range of 30 to 80° C., more preferably in the range of 40 to 65° C. in the first heating-up period of the toner with DSC. This is similar to the amorphous resin of the present invention. The glass transition temperature (Tg) may be measured with a known method (such as, DSC).

(Preferable Embodiment of Amorphous Polymer Segment)

It is preferable that the amorphous polymer segment of the present invention is the same kind of resin as the amorphous resin which is included in the binder resin, from the viewpoint of improving the affinity with the binder resin, and improving electric-charging uniformity of the toner. By making this embodiment, the affinity of the hybrid resin with the binder resin will be improved. Here, "the same kind of resin" indicates the resin in which a characteristic chemical bond is commonly included in the repeating unit.

The meaning of "the characteristic chemical bond" is determined by "polymer classification" indicated in a database provided by National Institute for Material Science (NIMS): (http://polymer.nims.go.jp/PoLyInfo/guide/jp/term polymer.html).

Namely, the chemical bonds which constitute the following 22 kinds of polymers are called as "the characteristic chemical bonds": polyacryls, polyamides, polyacid anhydrides, polycarbonates, polydienes, polyesters, poly-haloolefins, polyimides, polyimines, polyketones, polyolefins, polyethers, polyphenylenes, polyphosphazenes, polysiloxanes, polystyrenes, polysulfides, polysulfones, polyurethanes, polyureas, polyvinyls and other polymers.

"The same kind of resins" for the copolymer resins indicates resins having a common characteristic chemical bond in the chemical structure of a plurality of monomers which constitute the copolymer, when the copolymer has the monomers including the above-described chemical bonds as constituting units. Consequently, even if the resins each have a different property with each other, and even if the resins each have a different molar ratio of the monomers which constitute the copolymers, the resins are considered to be the same kind of resins as long as they contain a common characteristic chemical bond.

For example, the resin (or the resin unit) formed with styrene, butyl acrylate and acrylic acid and the resin (or the resin unit) formed with styrene, butyl acrylate and methacrylic acid both have at least a chemical bond constituting polyacrylate. Therefore, these two resins are the same kind of resins. Further examples are as follows. The resin (or the resin unit) formed with styrene, butyl acrylate and acrylic acid and the resin (or the resin unit) formed with styrene, butyl acrylate, acrylic acid, terephthalic acid, and fumaric acid both have at least a chemical bond constituting polyacrylate. Therefore, these two resins are also the same kind of resins.

Examples of an amorphous polymer segment are: vinyl polymer segment, urethane polymer segment, and urea polymer segment. Among them, the vinyl polymer segment is preferably used, because it can easily control the thermoplastic property. The vinyl polymer segment may be prepared in the same manner as preparation of the vinyl resin of the present invention.

(Preferable Content of Constituting Unit Derived from Styrene Monomer)

A preferable content of a constituting unit derived from a styrene monomer is in the range of 40 to 90 mass % from the viewpoint of easily controlling the plasticity of the hybrid resin. Moreover, from the same viewpoint, a preferable content of a constituting unit derived from a (meth) acrylic acid ester monomer is in the range of 10 to 60 mass %.

(Preferable Content of Bireactive Compound)

In addition, it is preferable that an amorphous polymer segment further contains the bireactive compound in the monomer from the viewpoint of incorporating a chemical bonding site with the crystalline polyester polymer segment in the amorphous polymer segment. A preferable content of the constituting unit derived from the bireactive compound in the amorphous polymer segment is in the range of 0.5 to 20 mass %.

(Preferable Content of Amorphous Polymer Segment in Hybrid Resin)

A content of the amorphous polymer segment in the hybrid resin is preferably in the range of 3 to 15 mass %, more preferably in the range of 5 to 10 mass %, and still more preferably in the range of 7 to 9 mass %, from the viewpoint of giving sufficient crystallization property to the hybrid resin.

(Production Method of Hybrid Resin)

A hybrid resin may be produced with the following first to third methods.

(First Production Method)

A first production method is a method for producing a hybrid resin having the following steps of: polymerizing an amorphous polymer segment at first; then forming a crystalline polyester polymer segment under the presence of the amorphous polymer segment.

In this method, an amorphous polymer segment is formed with an addition reaction of monomers constituting the above-described amorphous polymer segment (preferably, vinyl monomers such as a styrene monomer and a (meth) acrylate monomer).

Subsequently, a polyhydric alcohol component and a polycarboxylic acid component are made to polycondensed under the presence of the amorphous polymer segment to form a crystalline polyester polymer segment. During the moment in which a polyhydric alcohol component and a polycarboxylic acid component are made to polycondensed, the polyhydric alcohol component or the polycarboxylic acid component is made to conduct an addition reaction to the amorphous polymer segment. Thus, a hybrid resin is formed.

In the above-described first production method, it is preferable that the crystalline polyester polymer segment and the amorphous polymer segment each contain a portion where these two units can react with each other. Specifically, during the formation of the amorphous polymer segment, in addition to the monomers constituting the amorphous polymer segment, it is used a compound containing a portion which can react with a carboxy group or a hydroxy group remained in the crystalline polyester polymer segment and a portion which can react with the amorphous polymer segment. That is, by the reaction of this compound with a carboxy group or a hydroxy group remained in the crystalline polyester polymer segment, the crystalline polyester polymer segment can form a chemical bond with the amorphous polymer segment.

Alternatively, during the formation of the crystalline polyester polymer segment, it may be used a compound which can react with the polyhydric alcohol component or the polycarboxylic acid component, with the condition that this compound has a portion which can react with the amorphous polymer segment.

By using the above-described first production method, it may be formed a hybrid resin having a structure of a molecular bond (a graft structure) of the crystalline polyester polymer segment bonded to the amorphous polymer segment.

(Second Production Method)

A second production method is a method for producing a hybrid resin having the following steps of: respectively forming a crystalline polyester polymer segment and an amorphous polymer segment; and making to bond these two units.

In this method, a polycarboxylic acid component and a polyhydric alcohol component are made to be polycondensed to form a crystalline polyester polymer segment. Apart from a reaction system to forma crystalline polyester polymer segment, an amorphous polymer segment is formed by making an addition polymerization of monomers constituting the amorphous polymer segment. During this reaction, it is preferable to incorporate portions which can be mutually reacted by the crystalline polyester polymer segment and the amorphous polymer segment as described above.

Subsequently, by making to react the above-described crystalline polyester polymer segment with the amorphous polymer segment, it may be formed a hybrid resin having a structure of a molecular bond between the crystalline polyester polymer segment and the amorphous polymer segment.

When the above-described portions which may be reacted are not incorporated in the crystalline polyester polymer segment and the amorphous polymer segment, it may be formed a co-existing system of the crystalline polyester polymer segment and the amorphous polymer segment at first, then it may adopt a method of adding a compound having a portion which may be bonded to the crystalline polyester polymer segment and the amorphous polymer segment. It may be formed a hybrid resin having a structure of a molecular bond between the crystalline polyester polymer segment and the amorphous polymer segment.

(Third Production Method)

A third production method is a method for producing a hybrid resin having the following steps of: forming a crystalline polyester polymer segment at first; and making polymerization reaction to form an amorphous polymer segment under the presence of the crystalline polyester polymer segment.

In this method, a polycarboxylic acid component and a polyhydric alcohol component are made to polycondensed to form a crystalline polyester polymer segment at first.

Subsequently, monomers constituting the amorphous polymer segment are made to polymerize to form the amorphous polymer segment under the presence of the crystalline polyester polymer segment. During this reaction, in the same manner as in the above-described first production method, it is preferable to incorporate, in the crystalline polyester polymer segment or in the amorphous polymer segment, portions which can be mutually reacted by the crystalline polyester polymer segment and the amorphous polymer segment.

By using the above-described method, it may be formed a hybrid resin having a structure of a molecular bond (a graft structure) of the crystalline polyester polymer segment bonded with the amorphous polymer segment.

Among the first production method to the third production method as described above, the first production method is preferably used since this method enables to easily form a hybrid resin having a structure of an amorphous resin unit chain bonded with a crystalline polyester resin chain as a grafted portion, and this method can simplify the production method.

The first production method contains the steps of forming an amorphous polymer segment at first, then making to bond a crystalline polyester polymer segment. Consequently, the orientation of the crystalline polyester polymer segment will be uniform.

[Releasing Agent]

A releasing agent used for the present invention is not limited in particular. Any known waxes may be used.

A melting point of a releasing agent may be measured in the same manner as measurement of the binder resin.

A variety of known releasing agent may be used for the present invention. Examples of a usable releasing agent are: polyolefin waxes such as polyethylene wax and polypropylene wax; branched chain hydrocarbon wax such as microcrystalline wax; long chain hydrocarbon waxes such as paraffin wax (e.g., Fisher-Tropsch wax) and Sasol wax; dialkyl ketone wax such as distearyl ketone; ester waxes such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, tristeary trimellitate, and distearyl maleate; and amide waxes such as ethylenediamine behenyl behenate and tristearyamide trimellitate.

Releasing agents which may be used for the present invention will be further described in detail.

An ester wax which may be used contain at least an ester group in the molecule. Usable examples of an ester are any one of a monoester, a diester, a triester, and a tetraester. Specific examples of an ester are: esters made of a higher fatty acid and a higher alcohol represented by Formulas (1) to (3); trimethylolpropane triesters represented by Formula (4); glycerol triesters represented by Formula (5); and pentaerythritol tetraester represented by Formula (6).

$$R^1—COO—R^2 \quad \text{Formula (1):}$$

$$R^1—COO—(CH_2)_n—OCO—R^2 \quad \text{Formula (2):}$$

$$R^1—OCO—(CH_2)_n—COO—R^2 \quad \text{Formula (3):}$$

In Formulas (1) to (3), $R^1$ and $R^2$ each independently represent a non-substituted or a substituted hydrocarbon group having 13 to 30 carbon atoms, provided that $R^1$ and $R^2$ each may be the same or different. A suffix "n" represents an integer of 1 to 30.

$R^1$ and $R^2$ each represent a hydrocarbon group having 13 to 30 carbon atoms, and preferably, they represent a hydrocarbon group having 17 to 22 carbon atoms.

A suffix "n" represents an integer of 1 to 30, and preferably it represents an integer of 1 to 12.

Formula (4)

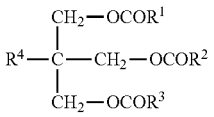

In Formula (4), $R^1$ to $R^4$ each independently represent a non-substituted or a substituted hydrocarbon group having 13 to 30 carbon atoms, provided that $R^1$ to $R^4$ each may be the same or different. Preferably, $R^1$ to $R^4$ each represent a hydrocarbon group having 17 to 22 carbon atoms.

Formula (5)

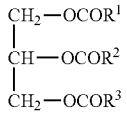

In Formula (5), $R^1$ to $R^3$ each independently represent a non-substituted or a substituted hydrocarbon group having 13 to 30 carbon atoms, provided that $R^1$ to $R^3$ each may be the same or different. Preferably, $R^1$ to $R^3$ each represent a hydrocarbon group having 17 to 22 carbon atoms.

Formula (6)

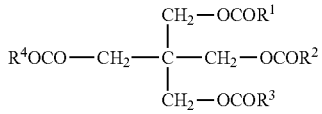

In Formula (6), $R^1$ to $R^4$ each independently represent a non-substituted or a substituted hydrocarbon group having 13 to 30 carbon atoms, provided that $R^1$ to $R^4$ each may be the same or different. Preferably, $R^1$ to $R^4$ each represent a hydrocarbon group having 17 to 22 carbon atoms.

A substituent which may be possessed by $R^1$ to $R^4$ is not limited in particular as long as it does not inhibit the effect of the present invention. Examples of the substituent include: a straight or branched chain alkyl group, an alkenyl group, an alkynyl group, an aromatic hydrocarbon ring group, an aromatic heterocyclic groups, a non-aromatic hydrocarbon ring group, a non-aromatic heterocyclic group, an alkoxy group, a cycloalkoxy group, an aryloxy group, an alkylthio group, a cycloalkylthio group, an arylthio group, an alkoxycarbonyl group, an aryloxycarbonyl group, a sulfamoyl group, an acyl group, an acyloxy group, an amide group, a carbamoyl group, a ureido group, a sulfinyl group, an alkylsulfonyl group, an arylsulfonyl group or a heteroarylsulfonyl group, an amino group, a halogen atom, a fluorinated hydrocarbon group, a cyano group, a nitro group, a hydroxy group, a thiol group, a silyl group, and a deuterium atom.

Specific examples of a monoester represented by Formula (1) are the following compounds represented by Formulas (1-1) to (1-8).

$$CH_3—(CH_2)_{12}—COO—(CH_2)_{13}—CH_3 \quad \text{Formula (1-1):}$$

$$CH_3—(CH_2)_{14}—COO—(CH_2)_{15}—CH_3 \quad \text{Formula (1-2):}$$

$$CH_3—(CH_2)_{16}—COO—(CH_2)_{17}—CH_3 \quad \text{Formula (1-3):}$$

$$CH_3—(CH_2)_{16}—COO—(CH_2)_{21}—CH_3 \quad \text{Formula (1-4):}$$

$$CH_3—(CH_2)_{20}—COO—(CH_2)_{17}—CH_3 \quad \text{Formula (1-5):}$$

$$CH_3—(CH_2)_{20}—COO—(CH_2)_{21}—CH_3 \quad \text{Formula (1-6):}$$

$$CH_3—(CH_2)_{25}—COO—(CH_2)_{25}—CH_3 \quad \text{Formula (1-7):}$$

$$CH_3—(CH_2)_{28}—COO—(CH_2)_{29}—CH_3 \quad \text{Formula (1-8):}$$

Specific examples of a diester represented by one of Formulas (2) and (3) are the following compounds represented by Formulas (2-1) to (2-7), and (3-1) to (3-3).

$CH_3—(CH_2)_{20}—COO—(CH_2)_4—COO—(CH_2)_{20}—CH_3$ Formula (2-1):

$CH_3—(CH_2)_{18}—COO—(CH_2)_4—OCO—(CH_2)_{18}—CH_3$ Formula (2-2):

$CH_3—(CH_2)_{20}—COO—(CH_2)_2—OCO—(CH_2)_{20}—CH_3$ Formula (2-3):

$CH_3—(CH_2)_{22}—COO—(CH_2)_2—COO—(CH_2)_{22}—CH_3$ Formula (2-4):

$CH_3—(CH_2)_{16}—COO—(CH_2)_4—OCO—(CH_2)_{16}—CH_3$ Formula (2-5):

$CH_3—(CH_2)_{26}—COO—(CH_2)_2—COO—(CH_2)_{26}—CH_3$ Formula (2-6):

$CH_3—(CH_2)_{20}—COO—(CH_2)_6—COO—(CH_2)_{20}—CH_3$ Formula (2-7):

$CH_3—(CH_2)_{21}—COO—(CH_2)_6—COO—(CH_2)_{21}—CH_3$ Formula (3-1):

$CH_3—(CH_2)_{23}—COO—(CH_2)_6—COO—(CH_2)_{23}—CH_3$ Formula (3-2):

$CH_3—(CH_2)_{19}—COO—(CH_2)_6—COO—(CH_2)_{19}—CH_3$ Formula (3-3):

Specific examples of a triester represented by Formula (4) are the following compounds represented by Formulas (4-1) to (4-6).

Formula (4-1)

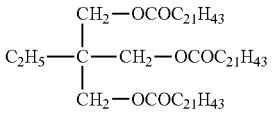

Formula (4-2)

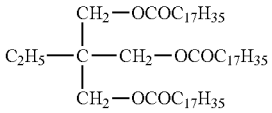

Formula (4-3)

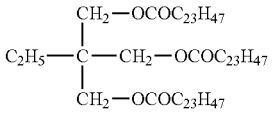

Formula (4-4)

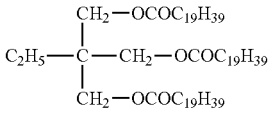

Formula (4-5)

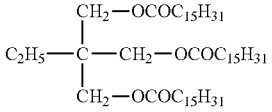

Formula (4-6)

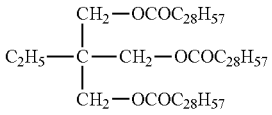

Specific examples of a triester represented by Formula (5) are the following compounds represented by Formulas (5-1) to (5-6).

Formula (5-1)

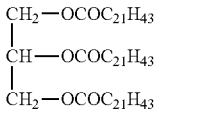

Formula (5-2)

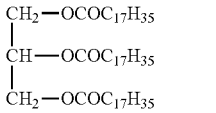

Formula (5-3)

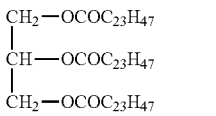

Formula (5-4)

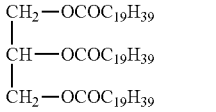

Formula (5-5)

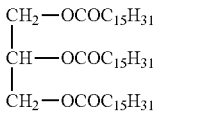

Formula (5-6)

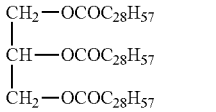

Specific examples of a tetraester represented by Formula (6) are the following compounds represented by Formulas (6-1) to (6-5).

Formula (6-1)

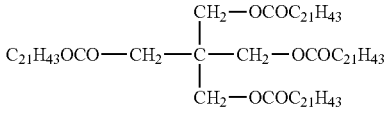

Formula (6-2)

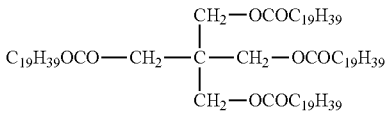

Formula (6-3)

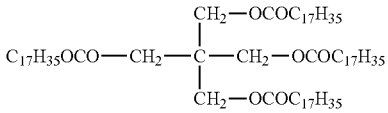

Formula (6-4)

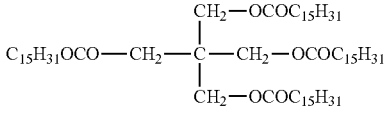

Formula (6-5)

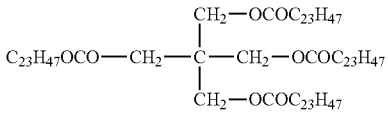

Among these compounds, preferable compounds are a monoester. An ester wax which is used as a releasing agent may have a structure containing a plurality of ester structures of a monoester, a diester, a triester and a tetraester in one molecule. As a releasing agent, a mixture of two or more kinds of esters may be used.

(Microcrystalline Wax)

As a releasing agent according to the present invention, a microcrystalline wax may be used as described above. "Microcrystalline waxes", as described herein, refer to those which differ from paraffin waxes in which the major component is straight-chain hydrocarbon (normal paraffin) and in which the ratio of branched-chain hydrocarbon (isoparaffin) and ring hydrocarbon (cycloparaffin) is greater. Generally, since the microcrystalline waxes incorporate a large amount of low crystalline isoparaffin and cycloparaffin, crystals are smaller than paraffin waxes, while the molecular weight thereof is greater than paraffin waxes.

The microcrystalline waxes have: the number of carbons of 30 to 60; the weight average molecular weight of 500 to 800; and the melting point of 60 to 90° C. As the microcrystalline waxes constituting the branched hydrocarbon waxes, preferred are those of a weight average molecular weight of 600 to 800, and a melting point of 60 to 85° C. Further preferred are those of a lower molecular weight, specifically more preferred are those of a number average molecular weight of 300 to 1,000, still further preferred are those of the number average molecular weight of 400 to 800. Further, it is preferable that the ratio of the weight average molecular weight to the number average molecular weight (Mw/Mn) is in the range of 1.01 to 1.20.

Examples of a microcrystalline wax of the present invention include: HNP-0190, Hi-Mic-1045, Hi-Mic-1070, Hi-Mic-1080, Hi-Mic-1090, Hi-Mic-2045, Hi-Mic-2065, and Hi-Mic-2095, as well as WAX EMW-0001 and EMW-0003 in which isoparaffin is a major component, all produced by Nippon Seiro Co., Ltd.

The presence or absence, or the value of the branched ratio in a microcrystalline wax may be determined via the spectrum obtained by the $^{13}$C-NMR measurement using the following Relation (i).

$$\text{Branched ratio (\%)}=(C3+C4)/(C1+C2+C3+C4)\times 100 \qquad \text{Relation (i):}$$

In the above Relation (i), C1 represents the peak area according to the primary carbon atom, and C2 represents the peak area according to the secondary carbon atom, C3 represents the peak area according to the tertiary carbon atom, and C4 represents the peak area according to the quaternary carbon atoms.

(Conditions of $^{13}$C-NMR Measurement Method)

Measuring apparatus: FT NMR apparatus LAMBDA 400 (made by JEOL
Ltd.)
Measurement frequency: 100.5 MHz
Pulse condition: 4.0 μs
Data points: 32,768
Delayed time: 1.8 second
Frequency range: 27,100 Hz
Integration repetition: 20,000 times
Measurement temperature: 80° C.
Solvents: benzene-$d^6$/o-dichlorobenzene-$d^4$=¼ (v/v)
Sample concentration: 3 mass %
Sample tube: Φ 5 mm
Measurement mode: $^1$H complete decoupling method (Preferable Kinds and Combination of Releasing Agent)

Among the exemplified releasing agents, in the present invention, it is preferable to contain an aliphatic ester wax having 30 to 72 carbon atoms. By this, it is easily achieving the crystallization temperature to be a preferable range (50 to 80° C.). Improved low-temperature fixability will be achieved. Specific examples of the aliphatic ester wax are: behenyl behenate, behenyl stearate, stearyl stearate, pentaerythritol tetrabehenate, pentaerythritol tetrastearate, and glycerin behenate. The present invention is not limited to them.

It is preferable that the releasing agent contains a hydrocarbon wax. In particular, it is preferable to contain a hydrocarbon wax having a branched structure. The branched structure promotes crystallization. As a result, $\Delta H_c$(L) may be suitably reduced. Consequently, the effect of the present invention may be suitably produced. A specific example of the hydrocarbon wax having a branched structure is Microcrystalline HNP-0190. The present invention is not limited to this.

It is further preferable that the releasing agent contains a hydrocarbon wax and an aliphatic acid ester wax having 30 to 72 carbon atoms. By this, it is easily achieving the crystallization temperature to be a more preferable range. Improved low-temperature fixability will be more easily achieved. By incorporating a hydrocarbon wax and an aliphatic acid ester wax having 30 to 72 carbon atoms as a releasing agent, a hydrocarbon wax having a high crystallization temperature is mixed with an aliphatic acid ester having a low crystallization temperature. This enable to promote crystallization of the aliphatic acid ester, and $\Delta H_c$ (L) may be suitably reduced. Consequently, the effect of the present invention may be suitably produced.

(Preferable Content of Releasing Agent)

It is preferable that a content of a releasing agent in the toner mother particles is in the range of 3 to 15 mass %. More preferably, it is in the range of 5 to 12 mass %.

<Colorant>

The colorant usable in the toner mother particles according to the present invention may be any known inorganic or organic colorant. Examples of a colorant include carbon black, magnetic powder, a variety of organic and inorganic pigments and dyes. The colorant is added in an amount of 1 to 30 mass %, preferably 2 to 20 mass % based on the amount of the toner mother particles.

The toner particles may contain a charge controlling agent or an external additive when required.

[Charge Controlling Agent]

As a charge controlling agent, it may be used the following known compounds. Examples thereof are: Nigrosine dyes, metal salts of naphthenic acid, metal salts of higher fatty acids, alkoxy amines, quaternary ammonium salts, azo type metal complexes, and salicylic acid metal salts. By adding a charge controlling agent, it can obtain a toner excellent in charge controlling property.

A content of the charge controlling agent in the toner is preferably in the range of 0.1 to 5.0 mass parts with respect to 100 mass parts of the binder resin in the toner.

[External Additive]

The toner particles of the present invention may be directly used for the toner. However, in order to improve fluidity, charging property, and cleaning property of the toner, it may be added an external additive such as fluidity increasing agent and cleaning assisting agent.

Examples of an external additive are: inorganic oxide fine particles such as silica fine particles, alumina fine particles, and titanium oxide fine particles; inorganic stearic acid compound fine particles such as aluminum stearate fine particles and zinc stearate fine particles; and inorganic titanium acid compound fine particles such as strontium titanate fine particles and zinc titanate fine particles. These may be used alone, or they may be used in combination of two or more kinds.

From the viewpoint of improving heat-resisting storage stability and environmental stability, these external additives may be subjected to a surface glossing treatment by using a silane coupling agent, a titan coupling agent, a higher aliphatic acid, or a silicone oil.

An added amount of the external additive (the total amount of the external additives when a plurality of external additives are used) is preferably in the rage of 0.05 to 5 mass parts with respect to 100 mass parts of toner particles. More preferably, it is in the rage of 0.1 to 3 mass parts.

[Core-Shell Structure]

The toner particles may be used without modification. However, they may have a multi-layered structure such as a core-shell structure (a morphology in which a shell layer is formed on the surface of the toner particle used as a core particle).

Here, the core-shell structure is not limited to a structure in which the shell layer completely covers the core particle. It includes a structure in which a part of the core particle is exposed.

The cross-sectional structure of the core-shell structure may be observed and confirmed with a known method such as a transmission electron microscope (TEM) or a scanning probe microscope (SPM).

In the case of the core-shell structure, the core particle and the shell layer each may have different glass transition point, melting point, and hardness. As a result, it is possible to make a toner design corresponding to the purpose. For example, a shell layer may be formed by aggregated and fused a resin having a high glass transition point (Tg) on the surface of a core particle containing a binder resin, a coloring agent and a releasing agent, and having a low glass transition point (Tg). Preferably, the shell layer contains an amorphous resin.

[Average Particle Size of Toner Particles]

It is preferable that the toner particles of the present invention have an average particle size of, for example, 3 to 10 μm, more preferably 5 to 8 μm in volume-based median diameter ($d_{50}$). When the volume-based median diameter ($d_{50}$) is within the above-described range, the minute dot image of 1200 dpi level may be faithfully reproduced.

The average particle size of the toner particles may be controlled by changing the concentration of the coagulant agent, the added amount of organic solvent, fusing time, the composition of the binder resin used in the production.

The volume-based median diameter ($d_{50}$) of the toner is measured and calculated by using measuring equipment composed of a "MULTISIZER 3" (Beckman Coulter Inc.) and a computer system installed with data processing software "Software V3.51" connected thereto. Specifically, a predetermined amount of a measuring sample (toner) is added to a predetermined amount of surfactant solution (for dispersing the toner particles, e.g. a surfactant solution prepared by eluting a neutral detergent containing a surfactant component with purified water by 10 times) and is allowed to be uniform, and then the solution is subjected to ultrasonic dispersion. The toner dispersion thus prepared is added to "ISOTON II" (Beckman Coulter Inc.) in a beaker placed in sample stand by a pipet until the concentration displayed on the measuring equipment reaches 8%. Within this concentration range, reproducible measurement values may be obtained. The measuring particle count and the aperture size of the measuring equipment are set to 25,000 and 100 μm respectively. The measuring range, which is from 2 to 60 μm, is divided into 256 sections to calculate the respective frequencies. The particle size where the accumulated volume counted from the largest size reaches 50% is determined as the volume-based median diameter ($d_{50}$).

[Average Circularity of Toner Particles]

It is preferable that the toner particles in the toner of the present invention have an average circularity of 0.930 to 1.000, more preferably 0.950 to 0.995 in terms of the stability of the charging characteristics and increasing the low-temperature fixability.

When the average circularity is within the above-described range, the individual toner particles are less crushable. This prevents the triboelectric charge applying member from smudges and it stabilizes the charging characteristics of the toners. Further, high quality images may be formed.

The average circularity of the toner particles may be obtained by measurement with an "FPIA-2100" (Sysmex Corp.). Specifically, a measuring sample (toner particles) is mixed with an aqueous solution containing a surfactant and is further dispersed by ultrasonic treatment for 1 minute. Thereafter, photographs are taken by means of the "FPIA-2100" (Sysmex Corp.) in the conditions of the HPF (high power imaging) mode at an adequate concentration corresponding to an HPF detect number of 3,000 to 10,000. The average circularity of the toner is calculated by determining the circularity of each toner particle according to the following Relation (I) and dividing the sum of the circularities of the individual toners by the total number of toner particles.

Circularity of toner particle=(Circumference of circle having the same area as projected image of particle)/(Perimeter of projected image of particle) Relation (I):

<Developer>

The electrostatic latent image developing toner of the present invention may be used as a magnetic or non-magnetic single-component toner, or it may be used as a double-component developer by mixing with a carrier. When the toner of the present invention is used as a double-component developer, as a carrier constituting the double-component developer, there may be utilized magnetic particles composed of materials conventionally known in the art including metals such as iron, ferrite, and magnetite, or alloys of these metals with aluminum or lead. Specifically, ferrite particles are preferable.

As a carrier, there may be utilized a coated carrier prepared by coating the magnetic particles with a resin, or a resin dispersion type carrier prepared by dispersing magnetic particles in a resin.

The volume-based median diameter ($d_{50}$) of the carrier is preferably 20 to 100 μm, it is more preferably 25 to 80 μm. It is possible to determine the volume-based median diameter ($d_{50}$) of the carrier by using laser diffraction system particle size distribution meter "HELOS" (produced by SYMPATEC Co.) provided with a wet type dispersing apparatus.

<<Production Method of Toner>>

The toner according to the present invention may be manufactured by any known process. Preferred examples of the production method include an emulsion polymerization aggregation process and an emulsion aggregation process.

An emulsion polymerization aggregation process which is preferably used for manufacturing the toner according to the present invention includes steps of mixing a dispersion liquid of microparticles of binder resin prepared by an emulsion polymerization process (hereinafter, also referred to as "binder resin microparticles"), a dispersion liquid of microparticles of a colorant (hereinafter, also referred to as "colorant microparticles") and a dispersion liquid of a releasing agent such as wax; allowing aggregation to proceed until a predetermined toner particle size is reached; and controlling the shape of the particles by fusing the binder resin microparticles.

An emulsion aggregation process which is preferably used for manufacturing the toner according to the present invention includes steps of adding dropwise a solution of a binding resin dissolved in a solvent to a poor solvent to prepare a dispersion liquid of the resin particles, mixing the resin particle dispersion liquid, a dispersion liquid of colorants, and a dispersion liquid of a releasing agent such as wax, allowing aggregation to proceed until a predetermined toner particle size is reached; and controlling the shape of the particles by fusion of the binder resin microparticles.

For manufacturing the toner according to the present invention, both processes can be applied.

An emulsion polymerization aggregation process is shown below as an example of manufacturing the toner according to the present invention.

(1) A step of preparing a dispersion liquid in which colorant microparticles are dispersed in an aqueous medium;

(2) A step of preparing a dispersion liquid in which binder resin microparticles, optionally containing an internal additive, are dispersed in an aqueous medium;

(3) A step of preparing a dispersion liquid of binder resin microparticles by emulsion polymerization;

(4) A step of forming toner mother particles by mixing the dispersion liquid of colorant microparticles and the dispersion liquid of binder resin microparticles to aggregate, associate, and fuse the colorant microparticles and the binder resin microparticles;

(5) A step of filtering the dispersion system (the aqueous medium) of toner mother particles to separate the toner mother particles for removing, for example, a surfactant;

(6) A step of drying the toner mother particles; and (7) A step of adding an external additive to the toner mother particles.

In the process of manufacturing toner by the emulsion polymerization aggregation process, the binder resin microparticles prepared by the emulsion polymerization process may have a multi-layered structure of two or more layers each composed of a binder resin having a different composition. The binder resin microparticles having a two-layer structure, for example, can be provided by preparing a dispersion liquid of binder resin particles according to the conventional emulsion polymerization process (first stage polymerization), followed by adding a polymerization initiator and a polymerizable monomer into the dispersion liquid to proceed the polymerization (second stage polymerization).

Toner particles having a core shell structure can be prepared by the emulsion polymerization aggregation process. The toner particles having a core shell structure can be prepared as follows. At first, core particles are prepared by aggregation, association and fusion of the binder resin microparticles for the core particles and the colorant microparticles. Then binder resin microparticles for the shell layer are added to the core particle dispersion liquid so as to aggregate and fuse onto the surface of the core particles, resulting in formation of the shell layer for covering the surface of the core particles, whereby the toner particles having the core shell structure are prepared.

A pulverization process is shown as an example of manufacturing toner of the present invention.

(1) A step of mixing a binder resin, a colorant, and an internal additive as necessary with, for example, a Henschel mixer;

(2) A step of kneading the resulting mixture with, for example, an extrusion kneader with heating;

(3) A step of coarsely pulverizing the resulting kneaded material with, for example, a hammer mill, followed by further pulverizing with, for example, a turbo mill pulverizer;

(4) A step of forming toner mother particles by powder classification process of the resulting pulverized material, for example, through an air sifter based on a Coanda effect; and (5) A step of adding external additives to toner mother particles.

The embodiments which may be applied the present invention are not limited to the above-mentioned embodiments. They may be changed within the scope in which the aim of the present invention is not deviated.

Although embodiments of the present invention have been described and illustrated in detail, it is clearly understood that the same is bay way of illustration and example only and not limitation, the scope of the present invention should be interpreted by terms of the appended claims.

EXAMPLES

Hereinafter, the present invention will be described by referring to specific examples, but the present invention is not limited thereto. In the present examples, the description of "parts" or "%" is used, it represents "mass parts" or "mass %" unless specific notice is given.

[Preparation of Toner]

[Preparation of Dispersion Liquid of Amorphous Resin Fine Particles (Amorphous Resin Dispersion Liquid) X1]

(1) First Step Polymerization

Into a 5 L reaction vessel equipped with a stirrer, a temperature sensor, a cooling tube and a nitrogen introducing device, 8 mass parts of sodium dodecyl sulfate and 3,000 mass parts of ion-exchanged water were charged. While stirring at a stirring speed of 230 rpm under a nitrogen flow, the inner temperature of the reaction vessel was raised to 80° C.

After the temperature was raised, an aqueous solution of 10 mass parts of potassium persulfate dissolved in 200 mass parts of ion-exchanged water was added thereto, and the liquid temperature was raised to 80° C. A monomer mixture 1 composed of the following was added thereto dropwise over 1 hour.

(Monomer Mixture 1)

Styrene: 480 mass parts;

n-Butyl acrylate: 250 mass parts; and

Methacrylic acid: 68 mass parts.

Then, the reaction system was heated and stirred at 80° C. for 2 hours to carry out the polymerization (first step polymerization). A dispersion liquid of resin fine particles (x1) was thus prepared.

(2) Second Step Polymerization

Into a 5 L reaction vessel equipped with a stirrer, a temperature sensor, a cooling tube and a nitrogen introducing device, a solution of 7 mass parts of sodium polyoxyethylene-2-dodecyl ether sulfate dissolved in 3,000 mass parts of ion-exchanged water was charged. After heating to 80° C., 80 mass parts of the dispersion liquid of the resin fine particles (x1) (in solid fraction), a monomer mixture 2 composed of the following and a releasing agent dissolved at 90° C. were added. The reaction system was mixed and dispersed for 1 hour by using a mechanical disperser with a circulation route "CLEARMIX" (M Technique Co., Ltd.) so that a dispersion containing emulsion particles (oil particles)

was prepared. The reaction system was mixed and dispersed for 1 hour by using a mechanical disperser with a circulation route "CLEARMIX" (M Technique Co., Ltd.) so that a dispersion containing emulsion particles (oil particles) was prepared. The following behenyl behenate is a releasing agent and it has a melting point of 73° C.

(Monomer Mixture 2)

Styrene: 285 mass parts;
n-Butyl acrylate: 95 mass parts;
Methacrylic acid: 20 mass parts;
n-Octyl-3-mercapto propionate: 8 mass parts;
Behenyl behenate: 190 mass parts.

The reaction system was mixed and dispersed for 1 hour by using a mechanical disperser with a circulation route "CLEARMIX" (M Technique Co., Ltd.) so that a dispersion liquid containing emulsion particles (oil particles) was prepared.

Then, an initiator solution of 6 mass parts of potassium persulfate dissolved in 400 mass parts of ion-exchanged water was added to the dispersion liquid, and the system was heated and stirred at 84° C. for 1 hour to carry out polymerization (second step polymerization). A dispersion liquid of resin fine particle dispersion (x2) was thus prepared.

(3) Third Step Polymerization

Then, 400 mass parts of ion-exchanged water were added to the dispersion liquid of resin fine particle dispersion (X2). After sufficiently mixing, a solution of 11 mass parts of potassium persulfate dissolved in 400 mass parts of ion-exchanged water was added to the dispersion liquid. A monomer mixture 3 composed of the following was added dropwise thereto at a temperature of 82° C. over 1 hour.

After the addition, the system was heated and stirred for 2 hours to carry out the polymerization (third step polymerization), and the system was then cooled to 28° C. A dispersion liquid of amorphous resin fine particles X1 was thus prepared. The amorphous resin was composed of a vinyl resin (styrene-acrylic resin).

(Monomer Mixture 3)

Styrene: 307 mass parts;
n-Butyl acrylate: 147 mass parts;
Methacrylic acid: 52 mass parts; and
n-Octyl-3-mercapto propionate: 8 mass parts.

The physical properties of the obtained amorphous resin dispersion liquid X1 were measured. The amorphous resin fine particles had a volume median particle size ($d_{50}$) of 220 nm, a glass transition temperature (Tg) of 46° C., and a weight average molecular weight of 32,000.

[Preparation of Amorphous Resin Dispersion Liquids X2 to X8, and X10]

Dispersion liquids of amorphous resin fine particles (amorphous resin dispersion liquids) X2 to X8, and X10 each were prepared in the same manner as preparation of the amorphous resin dispersion liquid X1 except that behenyl behenate used in the third step polymerization was replaced with releasing agents 1 to 7 as indicated in Tables 1 and 2.

TABLE 1

| Releasing agent No. | Kind | Melting point (° C.) |
|---|---|---|
| 1 | Behenyl behenate | 73 |
| 2 | Microcrystalline HNP-0190 | 82 |
| 3 | Stearyl stearate | 71 |
| 4 | Pentaerythritol tetrabehenate | 83 |
| 5 | Behenyl stearate | 70 |
| 6 | Pentaerythritol tetrastearate | 77 |
| 7 | Fisher-Tropsch wax FNP-0090 | 90 |
| 8 | Glycerin behenate | 68 |

[Preparation of Amorphous Resin Dispersion Liquid X9]

An amorphous resin dispersion liquid X9 was prepared in the same manner as preparation of the amorphous resin dispersion liquid X1 except that the monomer mixture 3 was replaced with the following monomer mixture 4.

(Monomer Mixture 4)

Styrene: 323 mass parts;
n-Butyl acrylate: 130 mass parts;
Methacrylic acid: 52 mass parts; and
n-Octyl-3-mercapto propionate: 10 mass parts.

[Preparation of Amorphous Resin Dispersion Liquid X11]

An amorphous resin dispersion liquid X11 was prepared in the same manner as preparation of the amorphous resin dispersion liquid X1 except that the monomer mixture 3 was replaced with the following monomer mixture 5.

(Monomer Mixture 5)

Styrene: 207 mass parts;
Methyl methacrylate: 100 mass parts;
n-Butyl acrylate: 147 mass parts;
Methacrylic acid: 52 mass parts; and
n-Octyl-3-mercapto propionate: 8 mass parts.

TABLE 2

| Amorphous dispersion liquid No. | Releasing agent No. | | Ratio |
|---|---|---|---|
| X1 | 1 | — | — |
| X2 | 1 | 2 | 95/5 |
| X3 | 1 | 2 | 85/15 |
| X4 | 3 | 2 | 95/5 |
| X5 | 4 | — | — |
| X6 | 5 | 2 | 95/5 |
| X7 | 6 | 2 | 95/5 |
| X8 | 1 | 7 | 95/5 |
| X9 | 1 | 2 | 95/5 |
| X10 | 8 | — | — |
| X11 | 1 | — | — |

[Synthesis of Crystalline Polyester Resin 1]

Into a reaction vessel equipped with a stirrer, a temperature sensor, a cooling tube, and a nitrogen introducing device were added 281 mass parts of dodecanedioic acid and 283 mass parts of 1,6-hexanediol. After replacing the inside of the reaction vessel with a dry nitrogen gas, 0.1 mass parts of $Ti(OBu)_4$ was added. The obtained mixture was heated at about 180° C. for 8 hours to make proceed the reaction. After further addition of 0.2 mass parts of $Ti(OBu)_4$, the temperature of the mixture was raised to 220° C., and the mixture was stirred over a period of 6 hours to make proceed the reaction. Then, the inner pressure of the reaction vessel was reduced to 1333.2 Pa. The reaction was made under the reduced pressure to obtain a crystalline polyester resin 1. The crystalline polyester resin 1 has a number average molecular weight (Mn) of 5,500, a weight average molecular weight (Mw) of 18,000, and a melting point (Tm) of 67° C.

[Synthesis of Crystalline Polyester Resin 2]

A crystalline polyester resin 2 was obtained in the same manner as preparation of the crystalline polyester resin 1 except that 1,6-hexanediol was replaced with 1,9-nonanediol (with using dodecanedioic acid). The crystalline polyester resin 2 has a number average molecular weight (Mn) of 4,300, a weight average molecular weight (Mw) of 19,200, and a melting point (Tm) of 66° C.

[Synthesis of Crystalline Polyester Resin 3]

A crystalline polyester resin 3 was obtained in the same manner as preparation of the crystalline polyester resin 1 except that dodecanedioic acid was replaced with decanedioic acid. The crystalline polyester resin 3 has a number average molecular weight (Mn) of 5,600, a weight average molecular weight (Mw) of 19,000, and a melting point (Tm) of 78° C.

[Synthesis of Hybrid Crystalline Polyester Resin (Crystalline Polyester Resin 4)]

Raw material monomers for an addition polymerization type segment (styrene-acrylic resin segment: St-Ac) including a bireactive monomer and a radical polymerization initiator as described below were loaded in a dropping funnel.

Styrene: 34 mass parts
n-Butyl acrylate: 12 mass parts
Acrylic acid: 2 mass parts
Di-t-butylperoxide (polymerization initiator): 7 mass parts The following raw material monomers for a poly-condensation type segment (crystalline polyester resin segment) were introduced in a four-necked flask equipped with a nitrogen introducing device, a dehydration tube, a stirrer, and a thermocouple. Then, the mixture was heated to 170° C. to dissolve the content.

Dodecanedioic acid: 250 mass parts
1,6-Hexanediol: 128 mass parts

Subsequently, the raw material monomers for an addition polymerization resin (St-Ac) was dropped over a period of 90 minutes, and an aging reaction was done for 60 minutes. Then, the unreacted raw material monomers for an addition polymerization resin were removed under a reduced pressure of 8 kPa. The amount of the removed monomers was very small compared with the raw monomers for the above-described resin.

Then, 0.8 mass parts of $Ti(OBu)_4$ were added as an esterification catalyst, and the mixture was heated to 235° C. The reaction was made under a normal pressure (101.3 kPa) for 5 hours, then further the reaction was made under a reduced pressure (8 kPa).

Subsequently, the reaction mixture was cooled to 200° C., and the reaction was made under a reduced pressure (20 kPa) for 1 hour. Thus, it was obtained a crystalline polyester resin 4 which is a hybrid crystalline polyester resin.

The obtained crystalline polyester resin 4 had a weight average molecular weight (Mw) of 18,000 and a melting point ($T_{mc}$) of 67° C.

[Preparation of Crystalline Resin Fine Particle Dispersion Liquid (Crystalline Dispersion Liquid) C1]

30 mass parts of the crystalline polyester resin 1 were melted, and the resin in the melted state was transferred to an emulsifying disperser "Cavitron CD1010" (manufactured by Eurotec) at a transfer rate of 100 mass parts per minute. Currently with the transfer of the resin 1 in the melted state, a dilute ammonia solution having a concentration of 0.37 mass % was transferred to the emulsifying disperser at a transfer rate of 0.1 L per minute while being heated to 100° C. with a heat exchanger. The dilute ammonia solution was prepared in an aqueous solvent tank by diluting a reagent ammonia water (70 parts by mass) with ion-exchanged water.

The emulsifying disperser was operated under conditions of a rotation rate of the rotor of 60 Hz and a pressure of 5 $kg/cm^2$ (490 kPa) to prepare a crystalline resin particle dispersion liquid (crystalline dispersion liquid) C1 containing crystalline polyester resin 1 having a volume-based median diameter ($d_{50}$) of 200 nm and a solid content of 30 parts by mass.

[Preparation of Crystalline Dispersion Liquid C2]

A crystalline resin fine particle dispersion liquid (crystalline dispersion liquid) C2 was prepared in the same manner as preparation of the crystalline dispersion liquid C1 except that the crystalline polyester resin 1 was replaced with the crystalline polyester resin 2. The $d_{50}$ of the particles of the crystalline polyester resin 2 in the crystalline dispersion liquid C2 was 230 nm.

[Preparation of Crystalline Dispersion Liquid C3]

A crystalline resin fine particle dispersion liquid (crystalline dispersion liquid) C3 was prepared in the same manner as preparation of the crystalline dispersion liquid C1 except that the crystalline polyester resin 1 was replaced with the crystalline polyester resin 3. The $d_{50}$ of the particles of the crystalline polyester resin 3 in the crystalline dispersion liquid C3 was 185 nm.

[Preparation of Crystalline Dispersion Liquid C4]

A crystalline resin fine particle dispersion liquid (crystalline dispersion liquid) C4 was prepared in the same manner as preparation of the crystalline dispersion liquid C1 except that the crystalline polyester resin 1 was replaced with the crystalline polyester resin 4. The $d_{50}$ of the particles of the crystalline polyester resin 4 in the crystalline dispersion liquid C4 was 185 nm.

[Preparation of Colorant Fine Particle Dispersion Liquid (Colorant Dispersion Liquid) (Bk)] 90 mass parts of sodium dodecyl sulfate were dissolved with stirring in 1, 600 mass parts of ion-exchanged water. While stirring this solution, 420 mass parts of carbon black "REGAL 330R" (made by Cabot Corporations) were gradually added to the solution. Then, the dispersion liquid was dispersed with a stirrer "Cleamix" (made by M Technique Co., Ltd.) to prepare a colorant fine particle dispersion liquid (colorant dispersion liquid) Bk.

A volume-based median diameter ($d_{50}$) of the particles in the colorant dispersion liquid Bk was 120 nm from the measurement with "Microtrac UPA-150" (made by Nikkiso Co., Ltd.).

[Synthesis of Amorphous Resin for Shell]

A monomer mixture 6 containing a bireactive compound (acrylic acid) with the following composition was loaded in a dropping funnel. Di-t-butyl peroxide was a polymerization initiator.

(Monomer Mixture 6)

Styrene: 80 mass parts;
n-Butyl acrylate: 20 mass parts;
Acrylic acid: 10 mass parts; and
Di-t-butyl peroxide: 16 mass parts The following raw material monomers for a poly-condensation type segment (amorphous polyester segment) were introduced in a four-necked flask equipped with a nitrogen introducing device, a dehydration tube, a stirrer, and a thermocouple. Then, the mixture was heated to 170° C. to dissolve the content.

2-mole propylene oxide adduct of bisphenol A: 285.7 mass parts;
Terephthalic acid: 66.9 mass parts; and
Fumaric acid: 47.4 mass parts.

Subsequently, to the obtained solution was added dropwise the monomer mixture 6 over 90 minutes. Then, after the reaction was continued for another 60 minutes, the unreacted monomers were removed under a reduced pressure (8 kPa) from the four-necked flask.

Then, 0.4 mass parts of $Ti(OBu)_4$ were added as an esterification catalyst to the four-necked flask, and the mixture was heated to 235° C. The reaction was made under a normal pressure (101.3 kPa) for 5 hours, then further the reaction was made under a reduced pressure (8 kPa). Thus it was obtained a amorphous resin for forming shell s1.

[Preparation of Dispersion Liquid of Resin Fine Particles for Shell (Dispersion Liquid for Shell) S1]

100 mass parts of an amorphous resin for shell s1 were dissolved in 400 mass parts of ethyl acetate (made by Kanto Kagaku Co. Ltd.). Subsequently, 638 mass parts of 0.26 mass % of sodium polyoxyethylene lauryl ether sulfate aqueous solution were added. While stirring this mixture, it was subjected to an ultrasonic dispersion for 30 minutes with an ultrasonic homogenizer "US-150T" (made by Nissei Co. Ltd.) under the condition of V-LEVEL being 300 μm. Subsequently, the mixture was stirred at 40° C. for 3 hours under a reduced pressure by using a diaphragm vacuum pump "V-700" (made by BUCHI Co. Ltd.). During this step, ethyl acetate was completely removed. Thus it was obtained a dispersion liquid of resin fine particles for shell (dispersion liquid for shell) S1 having a solid fraction of 13.5 mass %. The dispersion liquid for shell S1 contained resin particles for shell having a volume-based median diameter ($d_{50}$) of 160 nm.

[Preparation of Toner 1]

Into a reaction vessel equipped with a stirrer, a temperature sensor and a cooling tube, 288 mass parts (in solid fraction) of the amorphous resin dispersion liquid (X1), and 2,000 mass parts of ion-exchanged water were charged. Thereafter, the pH of the dispersion liquid in the reaction vessel was adjusted to 10 (at 25° C.) by adding a 5 mol/L sodium hydroxide aqueous solution.

Thereafter, 30 mass parts (in solid fraction) of the coloring agent dispersion liquid (Bk) was added thereto. Then, while stirring, an aqueous solution of 30 mass parts of magnesium chloride dissolved in 60 mass parts of ion-exchanged water was added at 30° C. over a period of 10 minutes. The temperature of the system was raised to 80° C., then, 40 mass parts of the crystalline dispersion liquid C1 were added to the mixture over 10 minute to allow the aggregation of the particles to continue.

While keeping this condition, the particle size of the aggregated particles was measured by using a "Coulter Multisizer 3" (made by Beckman Coulter, Inc.). When the volume median particle size $d_{50}$ reached 6.0 μm, 37 mass parts (in solid fraction) of the dispersion liquid S1 for shell formation were added to the mixture over 30 solid fraction) of the dispersion liquid S1 for shell formation were added to the mixture over 30 minutes. At the moment that the supernatant liquid of the reaction mixture became clear, an aqueous solution of 190 mass parts of sodium chloride dissolved in 760 mass parts of ion-exchanged water was added to terminate the particle growth.

Then, the reaction system was further heated and stirred at 80° C. to allow fusion of the particles to proceed. When the average circularity of the toner reached 0.945, the reaction solution was cooled to 30° C. at a cooling rate of 2.5° C./min. The average circularity of the toner was measured by using a measuring apparatus "FPIA-2100" (Sysmex Corp.) (HPF detect number of 4000).

Then, the above-described particles were separated from the cooled reaction solution. The obtained toner cake was dehydrated, and it was washed by repeating re-dispersion in ion-exchanged water and solid-liquid separation for 3 times. Thereafter, the toner cake was dried at 40° C. for 24 hours to yield toner mother particles 1.

To 100 mass parts of the obtained toner mother particles were added 0.6 mass parts of hydrophobic silica (number average primary particle size=12 nm, hydrophobicity=68) and 1.0 mass parts of hydrophobic titanium oxide (number average primary particle size=20 nm, hydrophobicity=63). The mixture was blended at 32° C. for 20 minutes by using a "Henschel mixer" (Nippon Coke & Engineering Co., Ltd.) in the condition of a rotary blade circumferential speed of 35 mm/sec. Thus there were prepared toner (1) having a volume average particle size of 6.1 μm. Then, coarse particles were removed by using a filter having an opening size of 45 μm. The external additive treatment was done as described above, and it was obtained a toner 1 which is an aggregate of toner particles 1 for electrostatic latent image development.

[Preparation of Developer 1]

A ferrite carrier covered with an acrylic resin and having a volume average particle size of 32 μm was added to the toner 1 so that the content of the toner particles became to be 6 mass %. Thus, it was prepared a developer 1 containing the toner 1. The developer 1 is a two-component developer.

[Preparation of Toners 2 to 14]

Toners 2 to 14 each were prepared in the same manner as preparation of the toner 1 except that the amorphous resin dispersion liquid X1 and the crystalline resin dispersion liquid C1 were changed as indicated in Table 3. Further, developers 2 to 14 each were prepared as described above for the developer 1.

TABLE 3

| Toner No. | Amorphous dispersion liquid No. | Crystalline dispersion liquid No. | Remarks |
|---|---|---|---|
| 1 | X1 | C1 | Inventive example |
| 2 | X2 | C1 | Inventive example |
| 3 | X3 | C1 | Inventive example |
| 4 | X4 | C1 | Inventive example |
| 5 | X5 | C1 | Inventive example |
| 6 | X6 | C1 | Inventive example |
| 7 | X7 | C1 | Inventive example |
| 8 | X8 | C1 | Inventive example |
| 9 | X2 | C2 | Inventive example |
| 10 | X2 | C4 | Inventive example |
| 11 | X9 | C1 | Inventive example |
| 12 | X10 | C3 | Comparative example |
| 13 | X1 | C1 | Comparative example |
| 14 | X11 | C1 | Comparative example |

[Evaluation]

Toners 1 to 14 were evaluated in accordance with the following ways. The evaluation results are listed in Table 4

(1) Measurement of Endothermic Peak Top Temperature and Exothermic Peak Temperature The toners 1 to 14 were subjected to the measurement using a thermal analysis instrument "Diamond DSC" (made by PerkinElmer Inc.) to obtain: an endothermic peak top temperature ($m_p$) in a heating-up period of the toner; a heat value $\Delta H_c$ being a heat value of the total exothermic peak in a heating-down period of the toner; and an exothermic peak top temperature $r_c$.

(2) Low-Temperature Fixability

The low-temperature fixability of the toners 1 to 14 each was evaluated by using the developers 1 to 14. The specific evaluation method was as follows.

The developers 1 to 14 each were loaded in a modified apparatus of a multi-function printer "bizhub PRO™ C6501" (made by Konica Minolta, Inc.). The modified apparatus was an apparatus having a fixing device modified in such a manner that the surface temperature of the heat roller for fixing was adjustable in the range of 85 to 210° C.

An A4 size plain paper (basis weight of 80 g/m$^2$) was used as a paper for evaluation. A fixing test was repeatedly conducted to fix a solid image having an amount of adhered toner of 11 mg/10 cm$^2$ on this paper under the condition of the predetermined temperature. The fixing temperature was gradually increased from 85° C. to 130° C. with a step of 5° C.

Subsequently, each of the printed matters obtained in the fixing test at different temperatures was folded by a folding machine so that the solid image was located on the front side. Then, air compressed at a pressure of 0.35 MPa was blown to the creases in the sample. The condition of the crease was ranked into 5 grades as described in the following evaluation criteria. Among the fixing tests having acquired Rank 3, the lowest fixing temperature in the fixing tests was taken as the lowest fixing temperature and the toner was evaluated.

(Criteria 1)

Rank 5: No peel-off is observed at the crease.

Rank 4: A partial peel-off is found along the crease.

Rank 3: A narrow linear peel-off is found along the crease.

Rank 2: A bold linear peel-off is found along the crease.

Rank 1: A large peel-off is found in the image.

Based on the lowest fixing temperature, a low-temperature fixability of each toner set was evaluated with the following evaluation criteria 2. The smaller the lowest fixing temperature, it indicates that the toner is excellent in low-temperature fixability. When the lowest fixing temperature of the toner is not more than 120° C. (◎, ○, and Δ, the toner has no problem for practical use, and it is decided that the toner passes examination.

◎: The lowest fixing temperature is less than 105° C.

○: The lowest fixing temperature is not less than 105° C. and less than 118° C.

Δ: The lowest fixing temperature is not less than 118° C. and less than 120° C.

X: The lowest fixing temperature is larger than 120° C.

(3) Image Noise

The image noise of the toners 1 to 14 after stored at a high temperature was evaluated as follows. The toners 1 to 14 were respectively stored under the conditions of 50° C. and 40% RH for 24 hours. Developers 1' to 14' were prepared in the same way as preparation of the developers 1 to 14 by using these toners. Specific evaluation method is described as follows.

[Evaluation]

An image forming apparatus "bizhub PRO™ C6500" (made by Konica Minolta, Inc.) was used as an evaluation instrument. The developers 1' to 14' were respectively loaded therein. A test image having a solid image with a printing ratio of 5% was printed under the conditions of high-temperature and high-humidity on an A4 size high quality paper (65 g/m$^2$) in an amount of 100,000 sheets of prints.

At an printing initial stage and after printing of 100,000 sheets of prints (hereafter, it may be called as "after long-term use") respectively, a gradation pattern image having a gradation ratio of 32 steps was printed out. Then, the gradation pattern was read with CCD, and the read value was subjected to Fourier transformation by taking consideration of MTF correction (Modulation Transfer Function). The GI (Graininess Index) value that was made to fit to human relative visibility was measured. The maximum GI value was obtained.

Here, the GI value has the following meaning. When the GI value is smaller, the Graininess of the image is smaller, and it is preferable.

This GI value is a value described in Journal of the Imaging Society of Japan, 39(2), 84-93 (2000). Based on the following evaluation criteria, the image noise was evaluated from the GI value of the gradation pattern in the image of an initial stage and after long-term use.

Namely, regarding to a gradation pattern image printed out at an initial stage, the maximum GI value ($GI_i$) of the image, and the maximum GI value ($GI_a$) of after long-term use were respectively calculated. Based on the difference ΔGI (=$GI_a$−$GI_i$), the image noise was decided based on the following criteria.

◎: ΔGI is in the range of 0 or more to less than 0.010

○: ΔGI is in the range of 0.01 or more to less than 0.020

X: ΔGI is in the range of 0.020 or more

TABLE 4

| | Releasing agent | | | | | | | | | | | | Evaluation | | |
|---|---|---|---|---|---|---|---|---|---|---|---|---|---|---|---|
| | First wax | | Second wax | | | Crystalline | Differential scanning calorimetry | | | | | | | Low-temperature | |
| Toner No. | No. | Carbon atom number | No. | Branch structure | Ratio | polyester No. | $m_p$ [° C.] | $r_c$ [° C.] | $r_c$ − 7 [° C.] | $\Delta H_c$ [J/g] | $\Delta H_c$ (L) [J/g] | $\Delta H_c$ (L)/$\Delta H_c$ [%] | Image noise | fixability | Remarks |
| 1 | 1 | 44 | — | — | — | 1 | 73 | 67 | 60 | 18.0 | 2.4 | 13.3 | ◎ | ◎ | Inv. |
| 2 | 1 | 44 | 2 | Present | 95/5 | 1 | 73 | 68 | 61 | 18.0 | 1.1 | 6.1 | ◎ | ◎ | Inv. |
| 3 | 1 | 44 | 2 | Present | 85/15 | 1 | 74 | 68.5 | 61.5 | 18.5 | 0.5 | 2.7 | ◎ | ○ | Inv. |
| 4 | 3 | 75 | 2 | Present | 95/5 | 1 | 70 | 55 | 48 | 18.0 | 2.4 | 13.3 | ○ | ◎ | Inv. |
| 5 | 4 | 93 | — | — | — | 1 | 83 | 79 | 72 | 22.0 | 1.3 | 5.9 | ◎ | ○ | Inv. |
| 6 | 5 | 40 | 2 | Present | 90/10 | 1 | 70 | 62 | 55 | 17.0 | 2.0 | 11.8 | ○ | ◎ | Inv. |
| 7 | 6 | 77 | 2 | Present | 95/5 | 1 | 77 | 73 | 66 | 23.0 | 1.1 | 4.8 | ◎ | ○ | Inv. |
| 8 | 1 | 44 | 7 | Absent | 95/5 | 1 | 74 | 67 | 60 | 18.2 | 1.8 | 9.9 | ○ | ○ | Inv. |
| 9 | 1 | 44 | 2 | Present | 95/5 | 2 | 73 | 66 | 59 | 19.6 | 2.0 | 10.2 | ○ | ○ | Inv. |
| 10 | 1 | 44 | 2 | Present | 95/5 | 4 | 73 | 66 | 59 | 18.8 | 1.2 | 6.4 | ◎ | ◎ | Inv. |
| 11 | 1 | 44 | 2 | Present | 95/5 | 1 | 73 | 64 | 57 | 18.9 | 1.0 | 5.3 | ◎ | ○ | Inv. |
| 12 | 8 | — | — | — | — | 1 | 68 | 56 | 49 | 18.3 | 3.6 | 19.7 | X | ○ | Comp. |
| 13 | 1 | 44 | — | — | — | 3 | 73 | 65 | 58 | 18.0 | 4.5 | 25.0 | X | ○ | Comp. |
| 14 | 1 | 44 | — | — | — | 1 | 73 | 67 | 60 | 18.0 | 3.7 | 20.6 | X | ○ | Comp. |

Inv.: Inventive example

Comp.: Comparative example

From the results in Table 4, it is clear that the toner of the present invention is capable of providing an electrostatic latent image developing toner excellent in low-temperature fixability without producing an image noise after keeping it for a long period of time under the condition of high temperature and high humidity.

What is claimed is:

1. An electrostatic latent image developing toner comprising: a binder resin; and a releasing agent, wherein the binder resin contains a crystalline polyester resin;

an endothermic peak top temperature of the electrostatic latent image developing toner is 70° C. or more measured with differential scanning calorimetry (DSC) in a heating-up period of the toner; and a heat value $\Delta H_c(L)$ is 15% or less with respect to a heat value $\Delta H_c$, wherein the heat value $\Delta H_c(L)$ is a heat value in the range of (an exothermic peak top temperature $r_c$−7° C.) or less; and the heat value $\Delta H_c$ is a heat value of the total exothermic peak measured with DSC in a heating-down period of the toner.

2. The electrostatic latent image developing toner described in claim 1, wherein the releasing agent contains an aliphatic acid ester wax having 30 to 72 carbon atoms.

3. The electrostatic latent image developing toner described in claim 1, wherein the releasing agent contains a hydrocarbon wax.

4. The electrostatic latent image developing toner described in claim 1, wherein the releasing agent contains a hydrocarbon wax and an aliphatic acid ester wax having 30 to 72 carbon atoms.

5. The electrostatic latent image developing toner described in claim 3, wherein the hydrocarbon wax contains a branched structure.

6. The electrostatic latent image developing toner described in claim 1, wherein the exothermic peak top temperature $r_c$ is in the range of 50 to 80° C., the exothermic peak top temperature being measured with DSC in a heating-down period of the toner.

7. The electrostatic latent image developing toner described in claim 1, wherein the exothermic top temperature $r_c$ is in the range of 60 to 75° C., the exothermic peak top temperature being measured with DSC in a heating-down period of the toner.

8. The electrostatic latent image developing toner described in claim 1, wherein the crystalline polyester resin contained in the binder resin is a hybrid crystalline polyester resin.

* * * * *